US009670676B2

(12) United States Patent
Sirowatka

(10) Patent No.: US 9,670,676 B2
(45) Date of Patent: Jun. 6, 2017

(54) TRUSS

(71) Applicant: Universal Forest Products, Inc., Grand Rapids, MI (US)

(72) Inventor: John Sirowatka, Alto, MI (US)

(73) Assignee: Universal Forest Products, Inc., Grand Rapids, MI (US)

( * ) Notice: Subject to any disclaimer, the term of this patent is extended or adjusted under 35 U.S.C. 154(b) by 97 days.

(21) Appl. No.: 14/662,621

(22) Filed: Mar. 19, 2015

(65) Prior Publication Data

US 2015/0267407 A1 Sep. 24, 2015

Related U.S. Application Data

(60) Provisional application No. 61/969,481, filed on Mar. 24, 2014.

(51) Int. Cl.
*E04C 3/16* (2006.01)
*E04C 3/17* (2006.01)

(52) U.S. Cl.
CPC ..... *E04C 3/16* (2013.01); *E04C 3/17* (2013.01); *E04B 2103/04* (2013.01)

(58) Field of Classification Search
CPC ..... E04C 3/16; E04C 3/17; E04C 2003/0486; E04C 2003/0491; E04C 3/292; E04B 2103/04; E04B 1/2608
USPC ..... 52/690, 693, 694, 695, 696, 633, 637, 52/638, 639, 648.1, 650.1, 652.1
See application file for complete search history.

(56) References Cited

U.S. PATENT DOCUMENTS 2,382,201 A * 8/1945 Burke ..... E04C 3/14 52/639
2,868,146 A * 1/1959 MacKintosh ..... E04B 1/2604 52/639
3,490,188 A * 1/1970 Troutner ..... E04C 3/12 52/644
3,867,803 A 2/1975 Platt
4,207,719 A * 6/1980 Knowles ..... E04C 3/292 52/693
4,336,678 A * 6/1982 Peters ..... B27M 3/0086 403/265
4,986,051 A * 1/1991 Meyer ..... E04C 3/07 14/74.5
5,022,211 A * 6/1991 Scott ..... E04C 3/06 52/566
5,253,465 A 10/1993 Gilb
5,426,822 A * 6/1995 Weir ..... E01F 8/0011 16/221
5,577,353 A * 11/1996 Simpson ..... E04B 7/022 403/170
5,592,800 A * 1/1997 Koo ..... E04C 3/292 52/692
5,867,963 A * 2/1999 Hershey ..... E04C 3/16 52/650.2

(Continued)

FOREIGN PATENT DOCUMENTS

EP 0093224 A1 9/1983
GB 1101152 A 1/1968

*Primary Examiner* — Theodore Adamos
(74) *Attorney, Agent, or Firm* — McGarry Bair PC

(57) ABSTRACT

A truss for incorporation into a building structure includes a fundamental component with at least one necked-down portion which changes the width or depth of the component. The fundamental component can be employed in joists, heels, and/or other joints for a roof truss.

20 Claims, 18 Drawing Sheets

(56) References Cited

U.S. PATENT DOCUMENTS

| | | | | |
|---|---|---|---|---|
| 6,047,513 | A * | 4/2000 | Gibson | E04B 1/24 52/640 |
| 6,148,579 | A | 11/2000 | Rolf | |
| 8,141,318 | B2 * | 3/2012 | Dunbar | E04C 3/07 52/636 |
| 2002/0040560 | A1 * | 4/2002 | Kent | E04C 3/16 52/633 |
| 2002/0148193 | A1 * | 10/2002 | Veilleux | E04C 3/16 52/847 |
| 2003/0089069 | A1 * | 5/2003 | Babich | E04B 1/2403 52/693 |
| 2004/0079044 | A1 * | 4/2004 | Troth | E04B 1/2608 52/696 |
| 2004/0211146 | A1 * | 10/2004 | Weeks | E04C 3/07 52/633 |
| 2006/0053732 | A1 * | 3/2006 | Watson | E04C 3/09 52/693 |
| 2008/0250747 | A1 * | 10/2008 | Johnson | E04C 3/16 52/693 |
| 2011/0036042 | A1 * | 2/2011 | Slaven, Jr. | E04C 3/122 52/650.1 |
| 2011/0302872 | A1 * | 12/2011 | Beaudoin | E04C 3/16 52/692 |

* cited by examiner

TRUSS

CROSS REFERENCE TO RELATED APPLICATION(S)

This application claims the benefit of U.S. Provisional Patent Application No. 61/969,481, filed Mar. 24, 2014, which is incorporated herein by reference in its entirety.

BACKGROUND

Buildings for residential, commercial, and agricultural construction can have a skeletal structure typically including a floor which supports one or more walls upon which a ceiling and roof are mounted. The ceiling and roof are typically formed by a roof truss, generally formed in a triangular shape which forms, at its lower surface, a ceiling for the interior of the structure and, at its upper surface, a roof for the exterior of the structure. The roof truss may define space for an attic or the like.

One category of roof trusses are metal plate connected ("MPC") wood trusses, in which wood truss members are coupled by metal connector plates. The wood truss members can be sawn lumber or engineered wood, such as but not limited to laminated veneer lumber, laminated strand lumber, parallel strand lumber, plywood, and oriented strand board. Sawn lumber is harvested lumber that is finished or planed, and cut to standardized width and depth dimensions.

Sawn lumber is generally categorized into the following three groups depending on size: boards, dimensional lumber, and timbers. Sizes of sawn lumber are specified using a nominal nomenclature. For example, 2×4 dimensional lumber actually measures 1½"×3½". Other nominal sizes consist of 2×2 (actually 1½"×1½"), 2×3 (actually 1½"×2½"), 2×6 (actually 1½"×5½"), 2×8 (actually 1½"×7¼") and others. Similar nominal nomenclature can be applied to engineered wood.

FIG. 1 shows some non-limiting conventional pieces of dimensional lumber. Different trusses use dimensional lumber in different orientations. Each orientation has its own advantages and disadvantages depending on the application. For example, a "2×" truss configuration refers to a truss in which all truss members are oriented such that their width when viewed from the front is 1½". The depth of all truss members is also equal when viewed from the side and dependent on the dimensional lumber used; for example, using 2×4 dimensional lumber results in a depth of 3½" while using 2×3 dimensional lumber results in a depth of 2½". Along the same lines, a "4×" truss configuration refers to a truss in which all truss members are oriented such that their width when viewed from the front is 3½". FIG. 1(*a*) illustrates this point by showing a piece of 2×4 dimensional lumber oriented in a 2× configuration, whereas FIG. 1(*b*) shows a piece of 2×4 dimensional lumber oriented in a 4× configuration. In the 4× configuration the lumber may be referred to as 4×2 or 2×4 (flat). FIGS. 1(*c*) and 1(*d*) show different orientations using 2×3 dimensional lumber. The "3×" truss configuration of FIG. 1(*d*) refers to a truss in which all truss members are oriented such that their width when viewed from the front is 2½". In the 3× configuration the lumber may be referred to as 3×2 or 2×3 (flat).

MPC wood trusses can be produced in different shapes and sizes. While various terms can be used to describe different exterior shapes and interior web configurations, there are three basic kinds: pitched truss, vertical parallel chord truss, and horizontal parallel chord truss.

FIG. 2 is a front view of a typical prior art pitched truss 10 using a 2× truss configuration. The pitched truss 10 typically includes a bottom chord 12, which can be mounted to the walls of the building, and two top chords 14 which are mounted to the outer ends of the bottom chord 12 at a heel 16 and meet at a peak 18. A portion of the top chords 14 may extend past the heel 16 to form an eave overhang 20. The chords 12, 14 may be single lengths of wood, or may be made up of shorter sections of wood connected at a splice 22, two of which are shown in FIG. 2 for exemplary purposes. Diagonal webs 24 extend between the bottom chord 12 and the top chords 14 for structural support. Conventional metal plates 26 typically accomplish many of the fixed connections between the wood members of the truss 10, and can be nailed into the wood members.

The pitched roof truss configuration provides open space within the confines of the chords 12, 14 and webs 24, which can be used for storage and/or living space. Generally a 2×10 or 2×12 bottom chord 12 is used to handle these storage or occupancy loads. However, a single bottom chord 12 has only a limited amount of strength and stiffness, thereby requiring something with more depth. In view of this, truss manufactures have incorporated a parallel chord truss configuration into roof trusses.

FIGS. 3-4 are front views of typical prior art parallel chord trusses 30, 32, in which the bottom and top chords 34, 36 are parallel. The vertical parallel chord truss 30 has the lumber oriented vertically, i.e. in a 2× truss configuration, while the horizontal parallel chord truss 32 has the lumber oriented horizontally, i.e. in a flat, 3×, or 4× truss configuration. Of the two parallel chord trusses, the horizontal parallel chord truss 32 is generally stronger, stiffer, and more economical compared to the vertical parallel chord truss 30, all other factors being equal. When the lumber is oriented vertically, these designs generally sacrifice open space within the interior portion of the truss.

Parallel chord trusses 30, 32 are sometimes used as joists in roof trusses. Some roof trusses have incorporated a vertical parallel chord type configuration. FIG. 5 is a front view of a first example of a prior art roof truss 40 with a vertical parallel chord configuration, which uses metal plates 42 as connectors. FIG. 6 is a front view of a second example of a prior art roof truss 44 with vertical parallel chord type configuration, which uses a combination of metal plates 46 and metal web members 48 as connectors. The metal web members 48 can be, for example, V-shaped members sold by MiTek under the name Posi-Strut®.

Other roof trusses, examples of which are shown in FIGS. 7-10, incorporate a horizontal parallel chord type configuration, in which the bottom chord is provided in the form of a horizontal parallel chord truss joist. These trusses have an upper top chord with a 2× truss configuration and a lower horizontal parallel chord truss joist having a non-2× truss configuration, and accommodate for this dimensional change in different ways.

FIG. 7 is a front view of a third example of a prior art roof truss 50 with a horizontal parallel chord type configuration. The roof truss shown is a 7/12 pitch truss 50 with two upper top chords 52 having a 2× truss configuration and a lower horizontal parallel chord truss joist 54 having a 3× or 4× truss configuration fastened together with a hanger-style metal connector 56 near the heel.

FIG. 8 is a front view of a fourth example of a prior art roof truss 60 with a horizontal parallel chord type configuration. The roof truss shown is a 12/12 pitch truss 60 with two upper top chords 62 having a 2× truss configuration and a lower horizontal parallel chord truss joist 64 having a 3× or 4× truss configuration fastened together with a hanger-style metal connector 66 near the heel.

FIG. 9 is a front view of a fifth example of a prior art roof rafter system 70 with a horizontal parallel chord type configuration. The roof rafter system 70 shown is a cape style, and includes two upper rafters 72 having a 2× truss configuration and a lower horizontal parallel chord truss joist 74 having a 4× truss configuration. The upper rafters 72 are fastened to the side face of the horizontal parallel chord truss joist 74 with mechanical fasteners such as nails, screws, or lag screws, and a plywood web 76 as shown in FIG. 10, which is a detailed view of the heel of the roof rafter system 70 shown in FIG. 9.

BRIEF SUMMARY

According to one embodiment of the invention, a truss for incorporation into a building structure includes a framework of truss members, a plurality of the truss members having a rectilinear cross-section defined by major dimensions including a width and a depth, a plurality of flat connector plates, each of the connector plates joining at least two of the plurality of the truss members by spanning the at least two of the plurality of the truss members, and at least one of the plurality of truss members having a necked-down portion that reduces one major dimension to the width or depth of an adjacent one of the plurality of the truss members to define a necked-down dimension, wherein the necked-down portion is connected with an adjacent one of the plurality of the truss members having a width or depth equal to the necked-down dimension by at least one of the plurality of connector plates.

DETAILED DESCRIPTION

Figure 1:
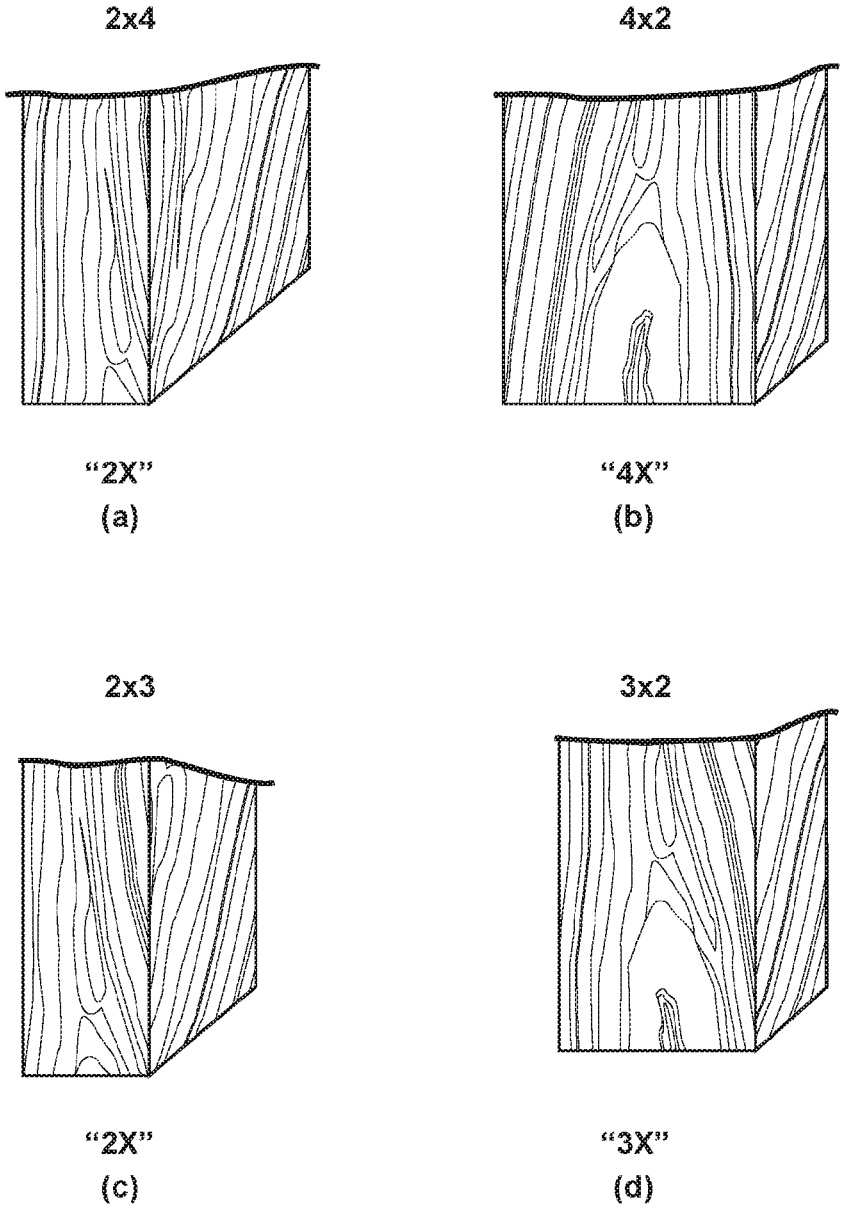
FIG. 1 (PRIOR ART)
FIG. 1 is a schematic view showing conventional pieces of dimensional lumber.
Figure 2:
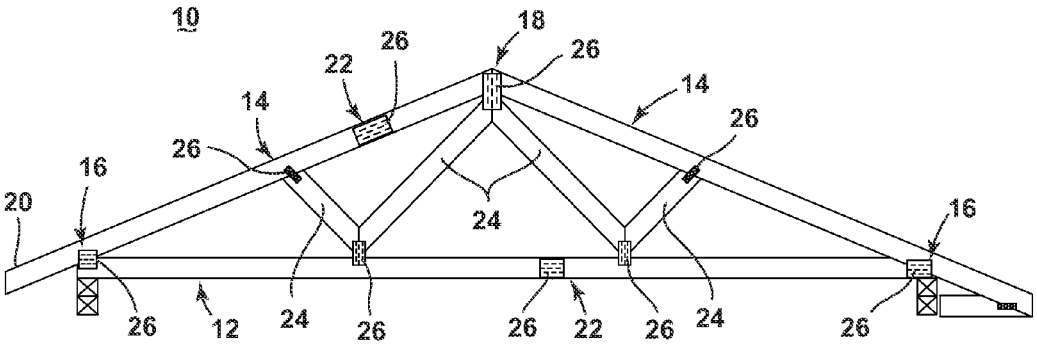
FIG. 2 (PRIOR ART)
FIG. 2 is a front view of a prior art pitched truss.
Figure 3:
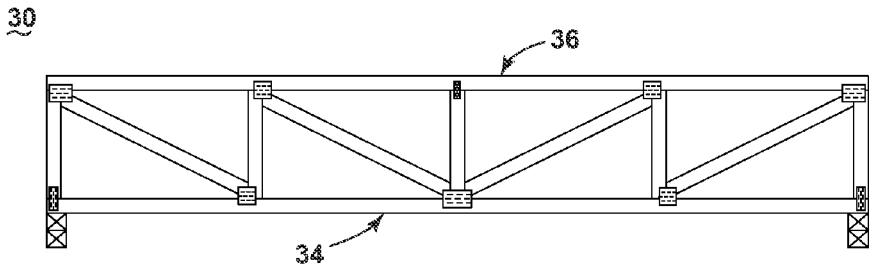
FIG. 3 (PRIOR ART)
FIG. 3 is a front view of a typical prior art parallel chord truss with lumber oriented vertically.
Figure 4:
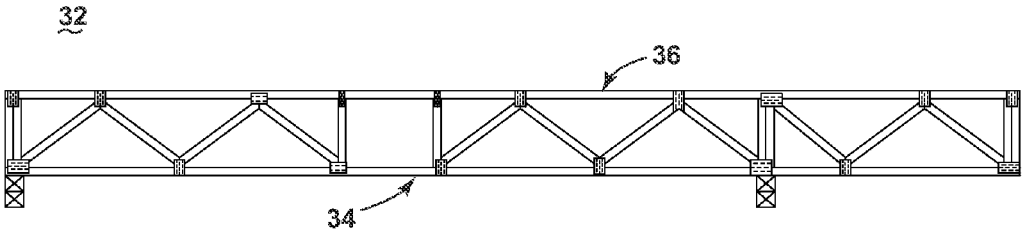
FIG. 4 (PRIOR ART)
FIG. 4 is a front view of a typical prior art parallel chord truss with lumber oriented horizontally.
Figure 5:
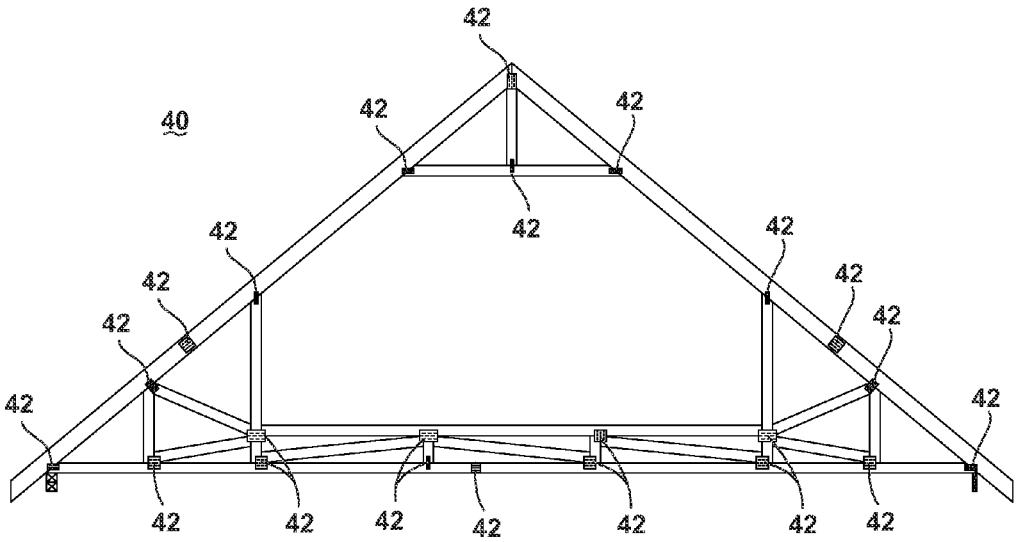
FIG. 5 (PRIOR ART)
FIG. 5 is a front view of a first example of a prior art roof truss with a vertical parallel chord configuration.
Figure 6:
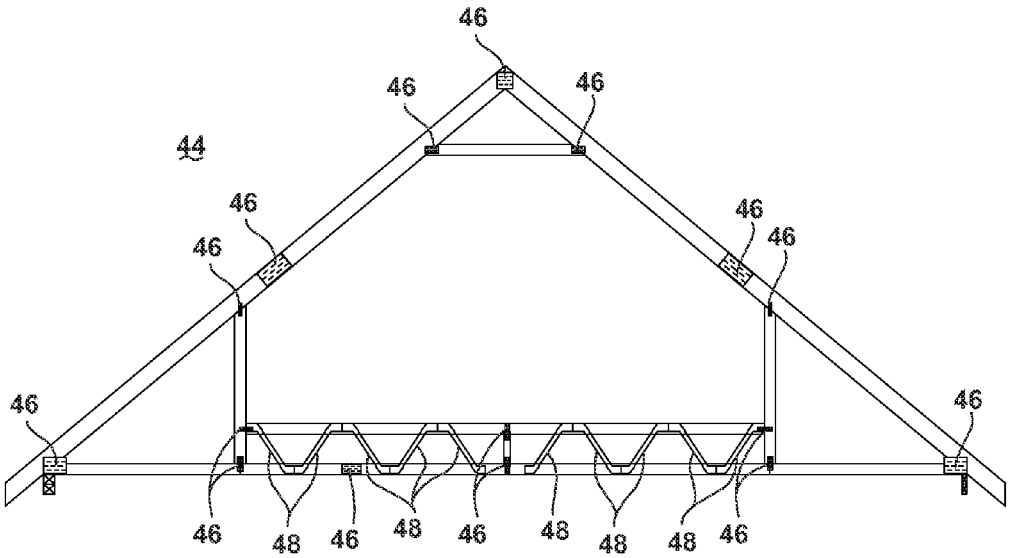
FIG. 6 (PRIOR ART)
FIG. 6 is a front view of a second example of a prior art roof truss with vertical parallel chord type configuration.
Figure 7:
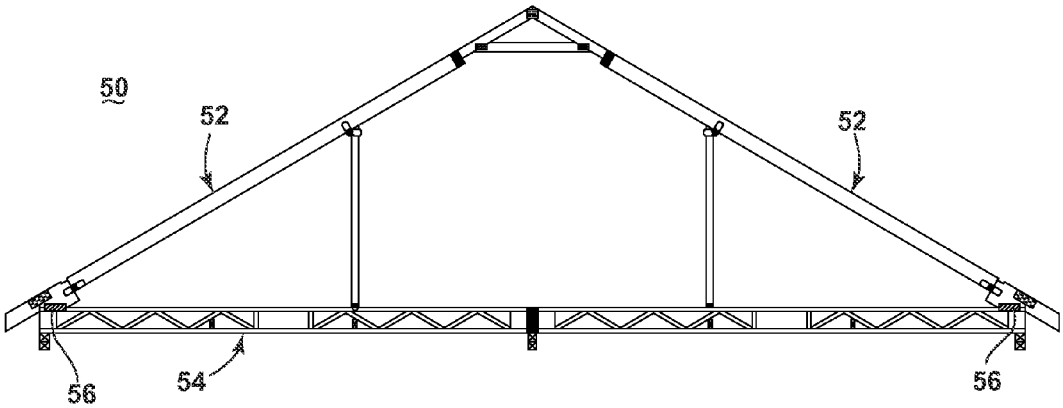
FIG. 7 (PRIOR ART)
FIG. 7 is a front view of a third example of a prior art roof truss with horizontal parallel chord type configuration.
Figure 8:
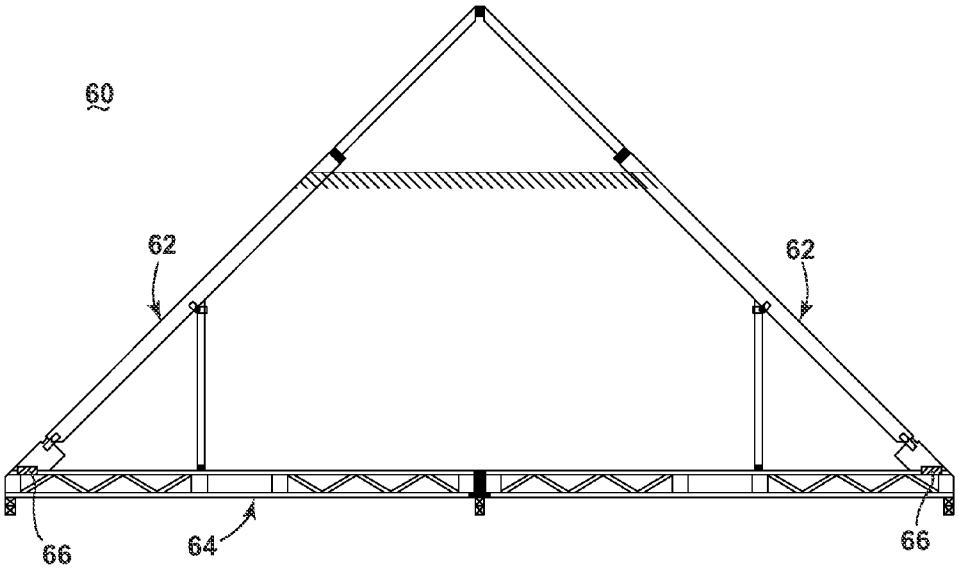
FIG. 8 (PRIOR ART)
FIG. 8 is a front view of a fourth example of a prior art roof truss with horizontal parallel chord type configuration.
Figure 9:
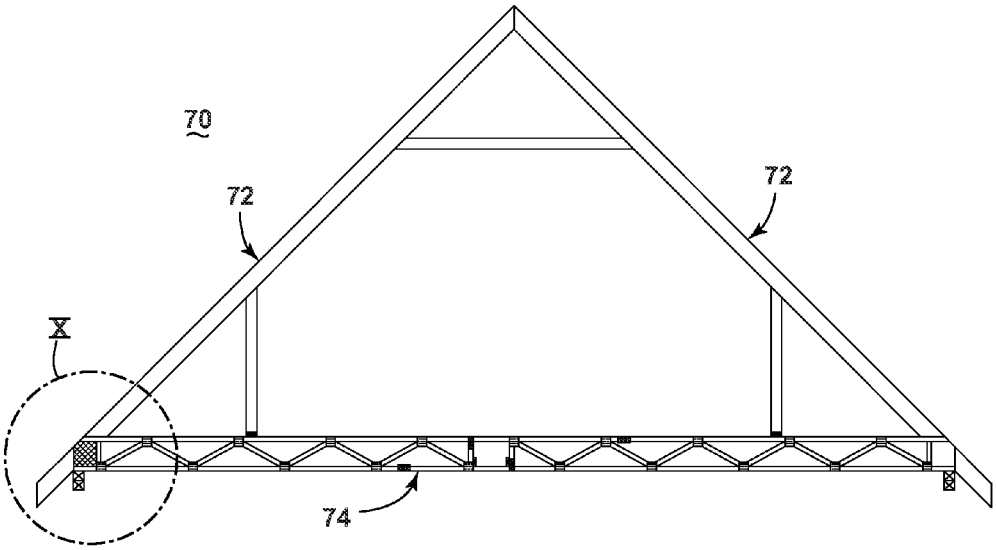
FIG. 9 (PRIOR ART)
FIG. 9 is a front view of a fifth example of a prior art roof rafter system with a horizontal parallel chord type configuration.
Figure 10:
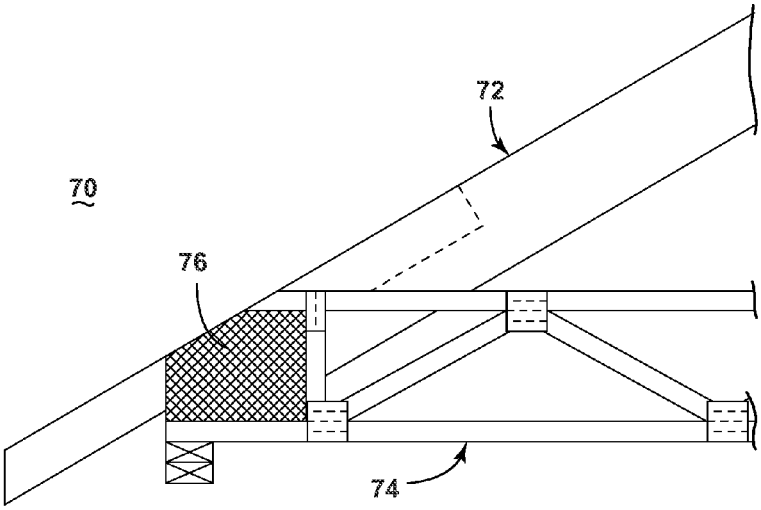
FIG. 10 (PRIOR ART)
FIG. 10 is a detailed view of the heel of the roof rafter system shown in FIG. 9.

The invention relates to trusses for incorporation into a building structure. In one of its aspects, the invention relates to an improved metal plate connected ("MPC") wood roof truss, including those used in residential construction (including but not limited to site built, manufactured homes, park trailers, and recreational vehicles), commercial construction (including but not limited to hotels, office, retail, wholesale, and factory buildings), and agricultural construction (including but not limited to metal clad and farm buildings). The roof trusses disclosed herein may have an attic space or the like. While discussed herein with reference to roof trusses, the invention also has application to joists and other trusses. Other fields in which the invention has potential application include the packaging, pallet and concrete forming industries.

Referring to the drawings, and in particular to FIGS. 11-15, various views and embodiments of a fundamental component for a truss according to several embodiments of the invention are shown. Using the fundamental component, a hybrid-type truss can be assembly in which lumber transitions between different configurations, but may still be connected with metal plates. For example, using a 2×4 for the fundamental component, a truss can be transitioned between a 2× configuration and a 4× configuration. Likewise, using a 2×3 for the fundamental component, a truss can be transitioned between a 2× configuration and a 3× configuration, and so on. By strategically using the fundamental component in a truss, many new truss configurations are possible.

Figure 11:
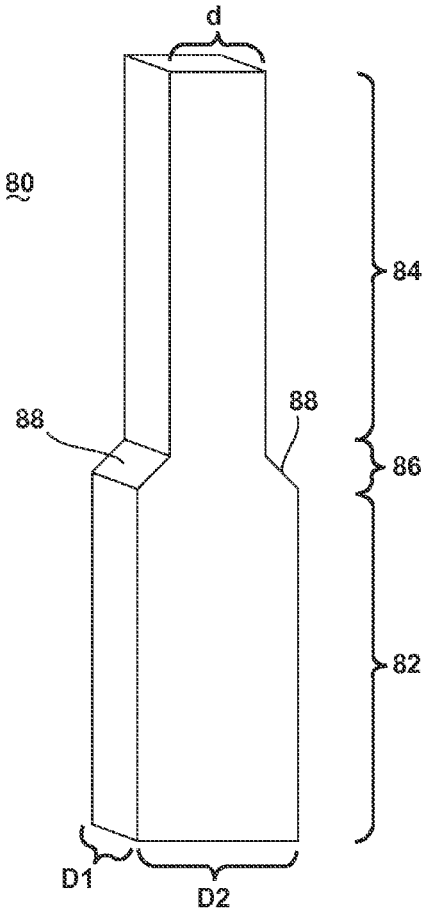
FIG. 11 is a perspective view of a fundamental component for a truss according to a first embodiment of the invention.
Figure 12:
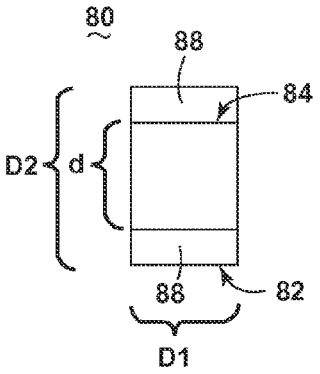
FIG. 12 is an end view of the fundamental component from FIG. 11.

FIGS. 11-12 are a perspective view and an end view of a fundamental component 80 for a truss according to a first embodiment of the invention. The fundamental component 80 includes an elongated rectilinear body having a major portion 82 and a minor portion 84 joined by at least one necked portion 86 which changes one major dimension (i.e., width or depth) D1, D2 of the body on either side of the necked portion 86 while the other major dimension stays the same to defined a necked-down portion of the component 80. For the fundamental component shown, approximately at the mid-point of its length, a first major dimension D1 of each portion 82, 84 remains substantially constant along the length of the body, but the necked portion 86 transitions the body from a second major dimension D2 at the major portion 82 down to a necked-down or lesser dimension d for the minor portion 84.

The cross-section of the fundamental component 80 at the major portion 82 can be rectangular, as shown, where the width and depth of the fundamental component 80 differ, or square, where the width and depth of the fundamental component 80 are equal. The length of the fundamental component 80 can vary, such as, but not limited to, from 1 to 10 ft., with a typical value of 6 ft. or more. The material for the fundamental component 80 can be sawn lumber or other engineered wood products.

In one non-limiting example, the fundamental component 80 can be manufactured from a piece of 2×4 dimensional lumber, such that the first major dimension D1 is approximately 1½", the second major dimension D2 is approximately 3½", and the lesser dimension d is approximately 1½". Using the fundamental component 80, a truss can be transitioned between a 2× configuration and a 4× configuration, and vice versa. In other examples, fundamental component 80 can be manufactured from other dimensional lumber, such as a 2×3, where the second major dimension D2 is approximately 2½", or 2×6, where the second major dimension D2 is approximately 5½".

It should be noted that while the fundamental component 80 is shown having a single necked portion 86 and the major and minor portions 82, 84 are shown as including terminal ends of the fundamental component 80, other configurations are possible. For example, the fundamental component 80 could have multiple necked portions 86, such that one major dimension of the body changes at more than one location along the length of the fundamental component 80. In one contemplated variation, both terminal ends of the fundamental component 80 can be necked down to a minor portion. Furthermore, while the terminal ends of the fundamental component 80 are shown as being substantially flat or planar, it is understood that the terminal ends could be profiled, for example being angled, chamfered, rounded, etc., as needed to fit a particular application.

Figure 13:
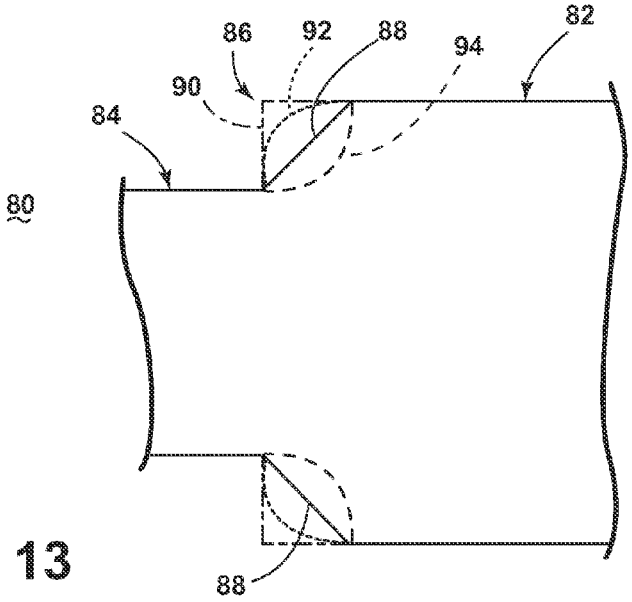
FIG. 13 is a close-up view of a necked portion of the fundamental component of FIG. 11.

FIG. 13 is a close-up view of the necked portion 86 of the fundamental component 80 of FIG. 11. The profile of the necked portion 86 can vary, with the illustrated necked portion 86 having shoulders 88 that taper gradually between the wide and narrow portions 82, 84 along an angled plane. Other examples of shoulders 88 can have a non-gradual or even square taper as shown in phantom line at 90, a rounded convex taper as shown in phantom line at 92, or a rounded concave taper as shown in phantom line at 94.

Figure 14:
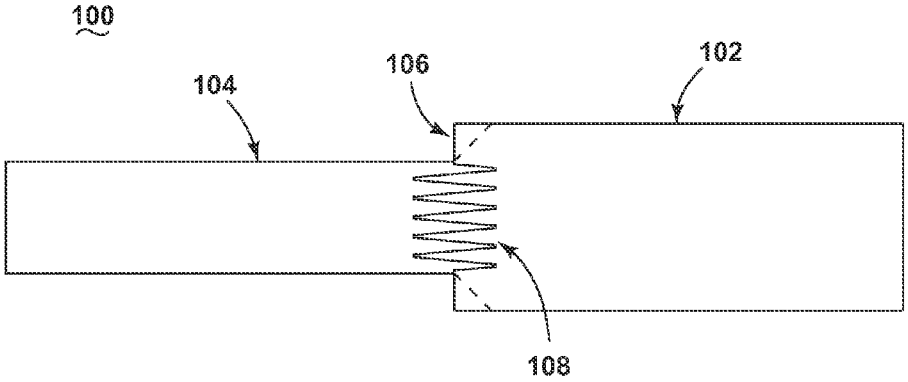
FIG. 14 is a top view of a fundamental component for a truss according to a second embodiment of the invention.

FIG. 14 is a top view of a fundamental component 100 for a truss according to a second embodiment of the invention. The fundamental component 100 can be substantially similar to the fundamental component 80 of the first embodiment, and includes an elongated rectilinear body having a major portion 102 and a minor portion 104 joined by at least one necked portion 106 which changes one major dimension of the body on either side of the necked portion 106 while the other major dimension stays the same. The fundamental component 100 differs from the fundamental component 80 of the first embodiment by providing the major and minor portions 102, 104 as separate members and connecting them together at or near the necked portion 106. Here, the major and minor portions 102 are connected at a finger joint 108. The finger joint 108 can be formed by vertical or horizontal grooves, which may further be triangular or rectangular in shape. Other suitable types of joints include, but are not limited to, a butt joint, a dovetail joint, or a lap joint. The material for the fundamental component 100 can be sawn lumber, other engineered wood products, or a combination of both.

Figure 15:
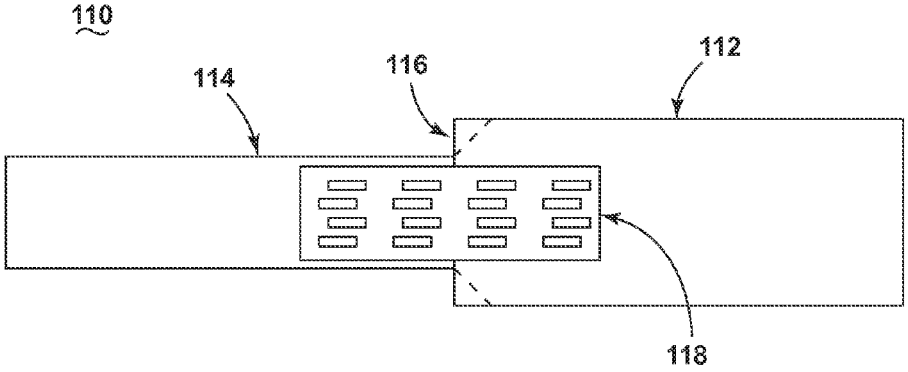
FIG. 15 is a top view of a fundamental component for a truss according to a third embodiment of the invention.

FIG. 15 is a top view of a fundamental component 110 for a truss according to a third embodiment of the invention. The fundamental component 110 can be substantially similar to the fundamental component 100 of the second embodiment, and includes an elongated rectilinear body having a major portion 112 and a minor portion 114 joined by at least one necked portion 116 which changes one major dimension of the body on either side of the necked portion 116 while the other major dimension stays the same. The fundamental component 110 differs from the fundamental component 100 of the second embodiment by using at least one mechanical fastener to connect the major and minor portions 112, 114 together at or near the necked portion 116. Here, the major and minor portions 102 are connected at a metal connector plate 118, such as a gang nail plate having a collection of teeth, spikes or nails projecting from one face. Other suitable types of mechanical fasteners include, but are not limited to a plywood gusset. The material for the fundamental component 110 can be sawn lumber, other engineered wood products, or a combination of both.

FIGS. 16-38 show various embodiments of roof trusses, joists, heels, and joints which can employ one or more fundamental components as part of the framework of truss members. For purposes of simplification, all fundamental components shown in FIGS. 16-38 are the single-piece fundamental components 80 as shown in FIGS. 11-13 of the first embodiment. However, it is understood that the roof trusses, joists, heels, and joints shown in FIGS. 16-38 could employ any of the fundamental components disclosed herein as part of the framework, such as the fundamental components 100, 110 of FIGS. 14-15, and that the roof trusses, joists, heels, and joints shown in FIGS. 16-38 are not limited to employing one type of fundamental component, but instead may use a combination of types. Furthermore, the fundamental components disclosed herein may be employed in roof trusses, joists, heels, or joints other than those explicitly shown in FIGS. 16-38.

Figure 16:
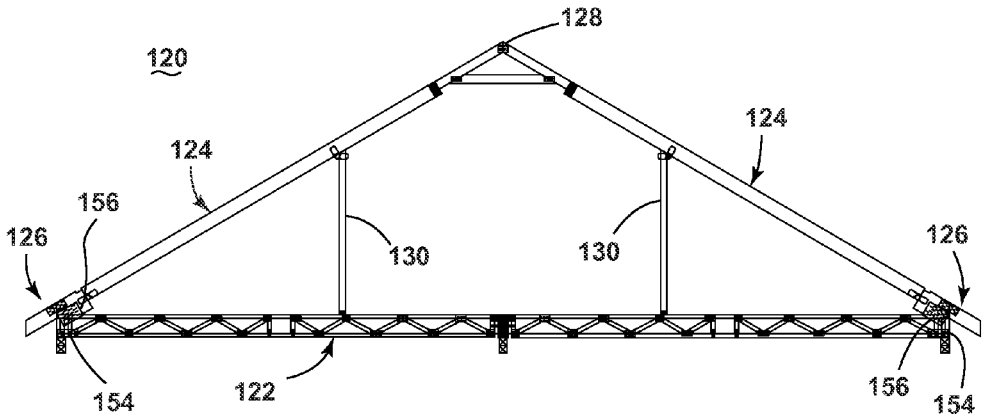
FIG. 16 is a front view of a pitched roof truss according to a fourth embodiment of the invention.

FIG. 16 is a front view of a pitched roof truss 120 according to a fourth embodiment of the invention. The roof truss 120 of the fourth embodiment can comprise a 7/12 pitch truss, and generally includes a bottom chord in the form of a parallel chord truss joist 122, and two top chords 124 which are mounted to the outer ends of the joist 122 at a heel 126 and meet at a peak 128. Vertical webs 130 extend between the joist 122 and the top chords 124 for structural support.

Figure 17:
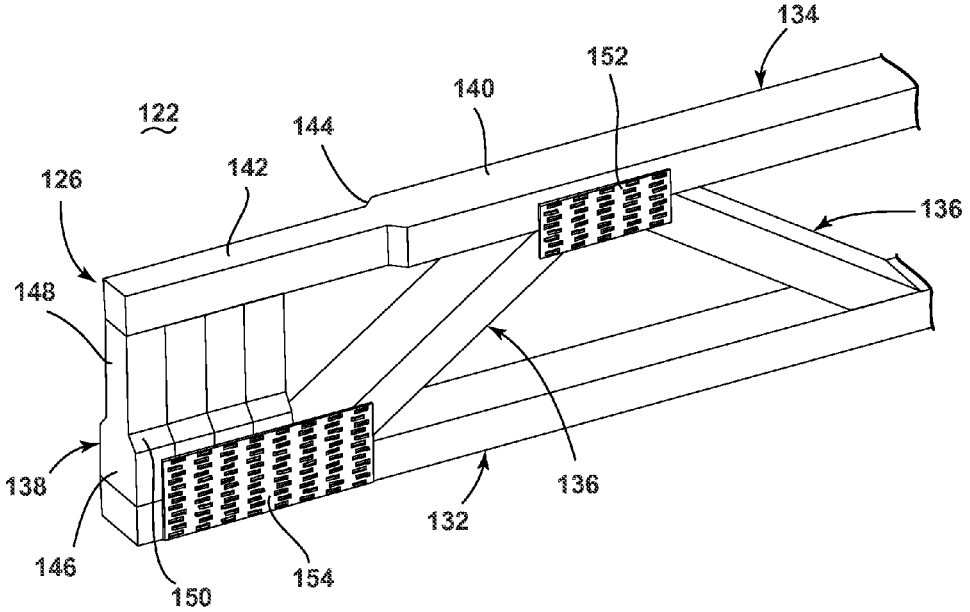
FIG. 17 is a detailed view of a truss joist at a heel of the truss from FIG. 16.

FIG. 17 is a detailed view of the joist 122 at the heel 126 of the roof truss 120 from FIG. 16. The joist 122 includes bottom and top chords 132, 134 which are parallel to each other, and multiple diagonal webs 136 that extend between the bottom and top chords 132, 134 for structural support. Multiple vertical webs 138 extend between the bottom and top chords 132, 134 at the end of the heel 126, and are stacked together in an abutting relationship.

The top chord 134 and vertical webs 138 can be formed as fundamental components as described above. Accordingly, the top chord 134 includes an elongated rectilinear body having a major portion 140 and a minor portion 142 joined by at least one necked portion 144. Similarly each vertical web 138 includes an elongated rectilinear body having a major portion 146 and a minor portion 148 joined by at least one necked portion 150. The vertical webs 138 are oriented with their major portions 146 abutted together against the upper surface of the bottom chord 132 and their minor portions 148 abutted together against the lower surface of the minor portion 142 of the top chord 134.

The major portions 140, 146 of the top chord 134 and vertical webs 138 have one major dimension, shown herein as the width, which is approximately the same as that of the bottom chord 132 and diagonal webs 136. As such, flat metal plates 152 can be used for the fixed connections between the diagonal webs 136 and the chords 132, 134, though only one of the metal plates 152 connecting the diagonal webs 136 to the top chord 134 is visible in FIG. 17. Likewise, another flat metal plate 154 can be used for the fixed connection between the end diagonal web 136, the bottom chord 132, and the major portions 146 of the vertical webs 138.

The necked portions 144, 150 change the widths of the top chord 134 and vertical webs 138, such that the minor portions 142, 148 are narrower. With the abutted configuration of the top chord 134 and vertical webs 138 shown in FIG. 17, a flat metal connector plate 156 (FIG. 16) can be used to join the joist 122 with the top chords 124 of the pitched roof truss 120 though the top chords 124 have a width that is smaller than that of the bottom chord 132 and diagonal webs 138.

In one example, the bottom chord 132 and diagonal webs 136 can be 3× or 4× wood members, and the top chords 124 can be 2× wood members. To join these members of differing dimensions, the top chord 134 and vertical webs 138 can be provided with necked portions 144, 150 which transition the top chord 134 and vertical webs 138 from 3× or 4× members to 2× members at or near the heel 126.

Figure 18:
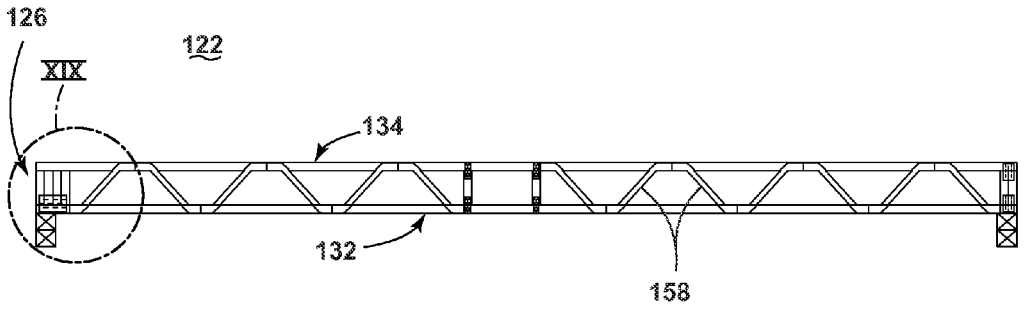
FIG. 18 is a front view of a truss joist according to a fifth embodiment of the invention.

FIG. 18 is a front view of a parallel chord truss joist 122 according to a fifth embodiment of the invention. The joist 122 of the fifth embodiment can be used on the roof truss 120 of FIG. 16, and like elements are identified with the same reference numerals. The fifth embodiment differs from the fourth embodiment in using metal web members 158 instead of diagonal webs 136. The metal web members 158 can be, for example, V-shaped members sold by MiTek under the name Posi-Strut®.

Figure 19:
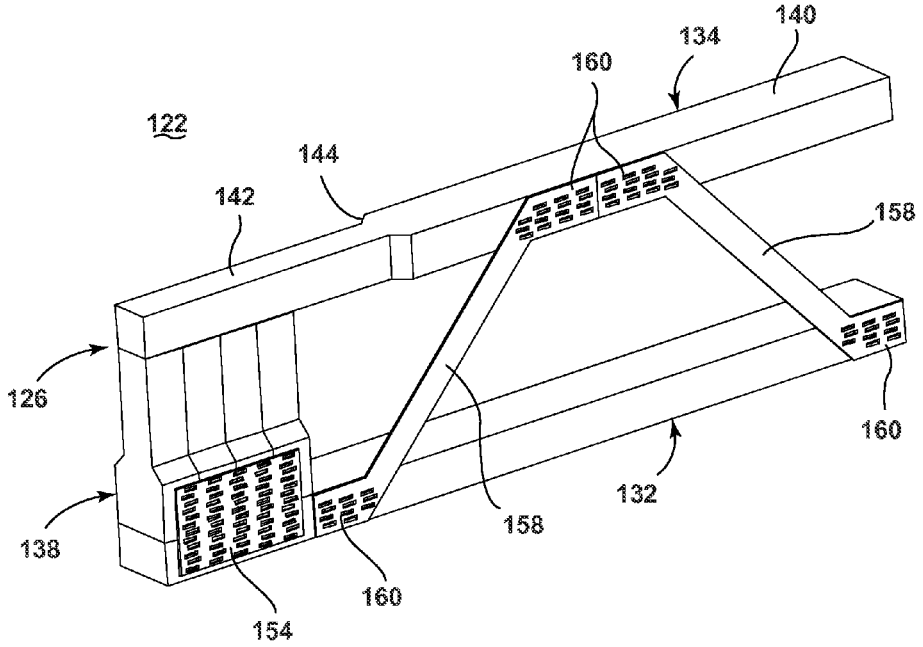
FIG. 19 is a detailed view of the heel of the truss joist from FIG. 18.

FIG. 19 is a detailed view of the joist 122 at the heel 126 of FIG. 18. The metal web members 158 extend between the bottom and top chords 132, 134 in a repeating V-pattern. The ends of the metal web members 158 are provided with integrally formed connector plates 160, such that the metal web members 158 can be nailed directly into the sides of the chords 134, 134. The endmost metal web member 158 is oriented to extend upwardly from the bottom chord 132 to the top chord 134 in a direction away from the heel 126 so that the upper plate 160 of the metal web member 158 meets the top chord 134 at the major portion 140 of the top chord 134.

Figure 20:
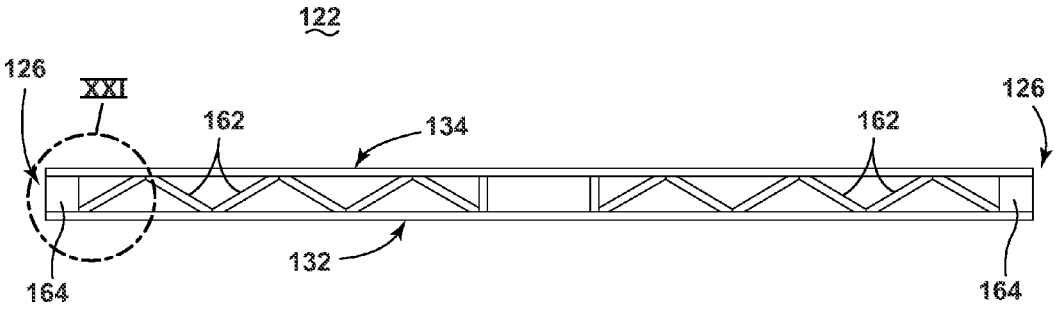
FIG. 20 is a front view of a truss joist according to a sixth embodiment of the invention.

FIG. 20 is a front view of a parallel chord truss joist 122 according to a sixth embodiment of the invention. The joist 122 of the sixth embodiment can be used on the roof truss 120 of FIG. 16, and like elements are identified with the same reference numerals. The sixth embodiment differs from the fourth embodiment in using diagonal webs 162 and an end brace member 164 that extend between and are adhered to the bottom and top chords 132, 134 for structural support, instead of the metal plate connected diagonal webs 136 and vertical webs 138 of the fourth embodiment. The truss joist 122 can be, for example, be configured as an Open Joist™ floor truss.

Figure 21:
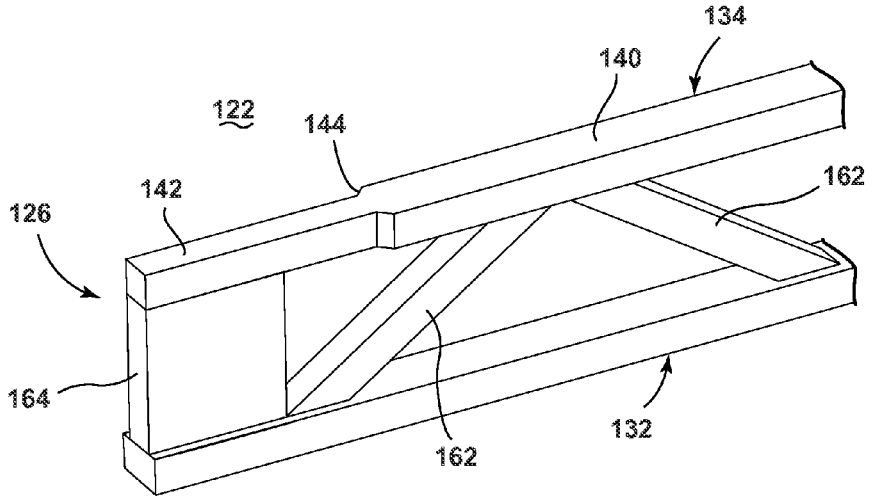
FIG. 21 is a detailed view of the heel of the truss joist from FIG. 20.

FIG. 21 is a detailed view of the joist 122 at the heel 126 of FIG. 20. The end brace member 164 extends vertically between the bottom chord 132 to the top chord 134, and meets the top chord 134 at the minor portion 142 of the top chord 134. The minor portion 142 of the top chord 134 has one major dimension, shown herein as the width, which is approximately the same as that of the end brace member 164. As such, a flat metal connector plate (not shown) can be used to join the joist 122 with the top chords 124 of the pitched roof truss 120 shown in FIG. 16.

Figure 22:
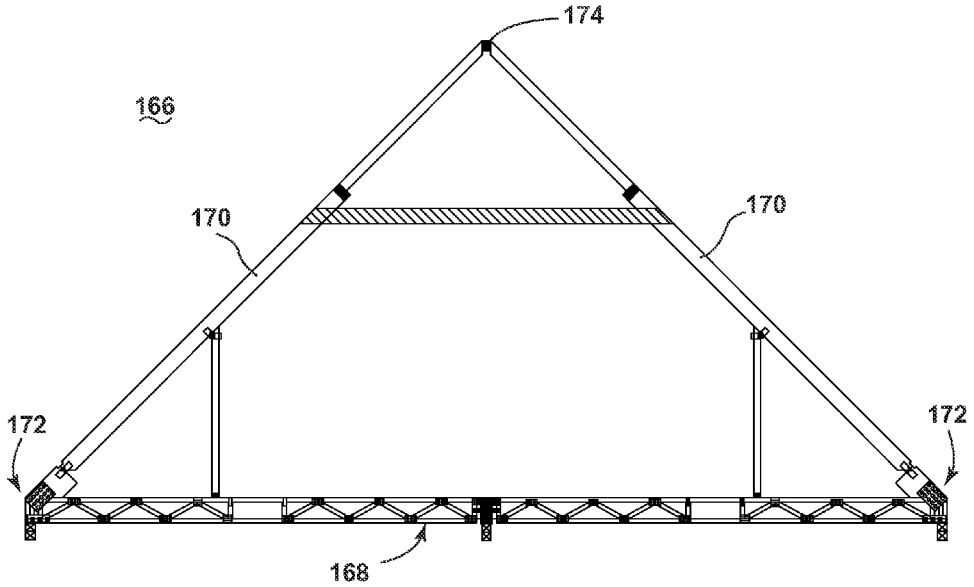
FIG. 22 is a front view of a pitched roof truss according to a seventh embodiment of the invention.

FIG. 22 is a front view of a pitched roof truss 166 according to a seventh embodiment of the invention. The roof truss 166 of the seventh embodiment can comprise a 12/12 pitch truss, and generally includes a bottom chord in the form of a parallel chord truss joist 168, and two top chords 170 which are mounted to the outer ends of the joist 168 at a heel 172 and meet at a peak 174. While not illustrated in detail, the heel 172 of the roof truss 166 can have a configuration that is substantially identical to the heel 126 of the fourth embodiment shown in FIG. 17, such that the nominal dimensions of the members used for at least some of the lower members of truss 166 can be larger than those of the upper members of the truss 166, as described while still using flat metal connector plates. For example, the lower members of truss 166, like the bottom chord and diagonal webs of the joist 168 can be 3× or 4× wood members, while the top chords 170 can be 2× wood members.

Figure 23:
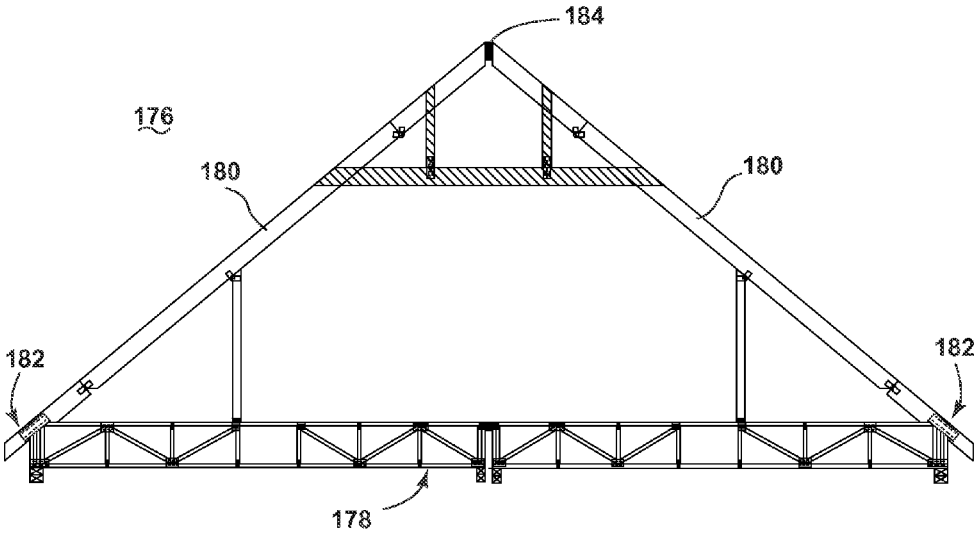
FIG. 23 is a front view of a pitched roof truss according to an eighth embodiment of the invention.

FIG. 23 is a front view of a pitched roof truss 176 according to an eighth embodiment of the invention. The roof truss 176 of the eighth embodiment can comprise a 10/12 pitch truss, and generally includes a bottom chord in the form of a parallel chord truss joist 178, and two top chords 180 which are mounted to the outer ends of the joist 178 at a heel 182 and meet at a peak 184. While not illustrated in detail, the heel 178 of the roof truss 176 can have a configuration that is substantially identical to the heel 126 of the fourth embodiment shown in FIG. 17, such that the nominal dimensions of the members used for at least some of the lower members of truss 176 can be larger than those of the upper members of the truss 176, while still using flat metal connector plates for the fixed connections. For example, the lower members of truss 176, like the bottom chord and diagonal webs of the joist 178 can be 3× or 4× wood members, while the top chords 180 can be 2× wood members.

Figure 24:
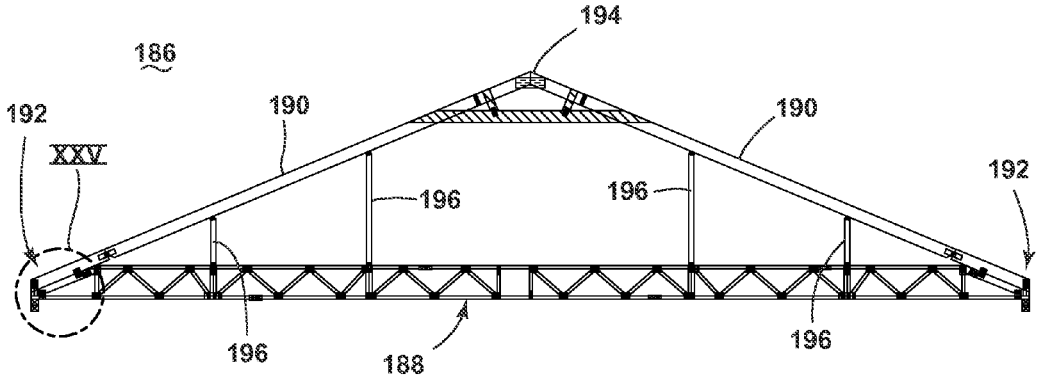
FIG. 24 is a front view of a pitched roof truss according to a ninth embodiment of the invention.

FIG. 24 is a front view of a pitched roof truss 186 according to a ninth embodiment of the invention. The roof truss 186 of the ninth embodiment can comprise a 5/12 pitch truss, and generally includes a bottom chord in the form of a parallel chord truss joist 188, and two top chords 190 which are mounted to the outer ends of the joist 188 at a heel 192 and meet at a peak 194. Vertical webs 196 extend between the joist 188 and the top chords 190 for structural support.

Figure 25:
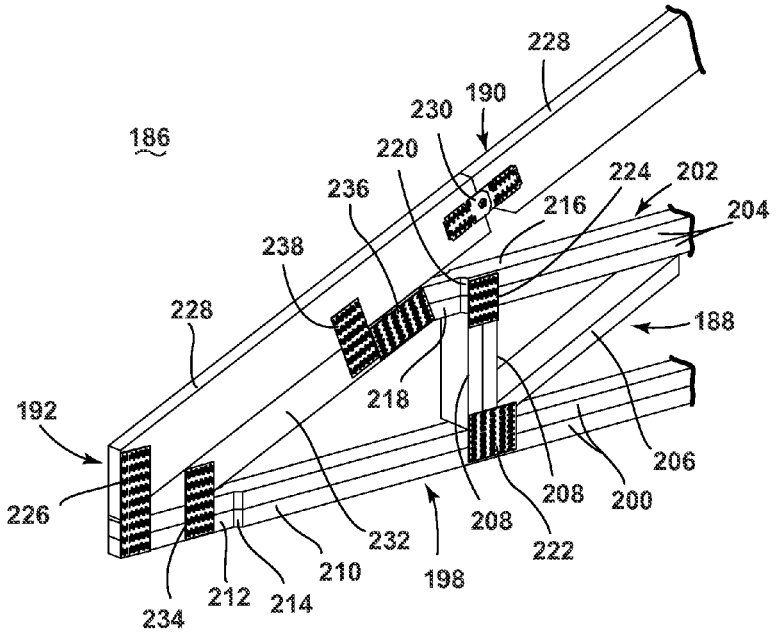
FIG. 25 is a detailed view of the heel of the roof truss from FIG. 24.

FIG. 25 is a detailed view of the heel 192 of the roof truss 186 from FIG. 24. The joist 188 includes a bottom chord 198 defined by two stacked members 200 and a top chord 202 which is parallel to the bottom chord 198 and defined by two stacked members 204. Multiple diagonal webs 206 extend between the chords 198, 202 for structural support. Multiple vertical webs 208 also extend between the chords 198, 202 and are abutted by one of the diagonal webs 206. At the heel 192, for example, two vertical webs 208 are stacked together in an abutting relationship with the endmost diagonal web 206.

The stacked members 200, 204 can be formed as fundamental components, described above. Accordingly, the bottom stacked members 200 each include an elongated rectilinear body having a major portion 210 and a minor portion 212 joined by at least one necked portion 214. Similarly each of the top stacked members 204 includes an elongated rectilinear body having a major portion 216 and a minor portion 218 joined by at least one necked portion 220. The stacked members 200, 204 are oriented with their minor portions 212, 218 aligned together and facing the heel 192.

The major portions 210, 216 of the chords 198, 202 have one major dimension, shown herein as the width, which is approximately the same as that of the diagonal and vertical webs 206, 208. As such, flat metal plates 222, 224 can be used for the fixed connections between the major portions 210, 216 and the webs 206, 208.

The necked portions 214, 220 change the widths of the chords 198, 202, such that the minor portions 212, 218 are narrower. The top chord 190 is connected with the minor portions 212 of the bottom stacked members 200 using a flat metal plate 226, and can include two members 228 fastened together with a hinged truss plate connector 230 near the heel 186. A brace member 232 can extend beneath the top chord 190 between the bottom chord 198 and top chord 202, and flat metal plates 234, 236, 238 can be used to fasten the brace member 232 to the bottom chord 198 of the joist 188, the top chord 202 of the joist 188, and the top chord 190 of the roof truss 186, respectively.

In one example, the diagonal and vertical webs 206, 208 can be 3× or 4× wood members, and the top chords 190 and brace member 232 can be 2× wood members. To join these members of differing dimensions, the chords 198, 202 of the truss joist 188 can be provided with necked portions 214, 220 which transition the stacked members 200, 204 from 3× or 4× members to 2× members at or near the heel 192. The 3× or 4× members are used for substantially the full span of the truss 186.

Figure 26:
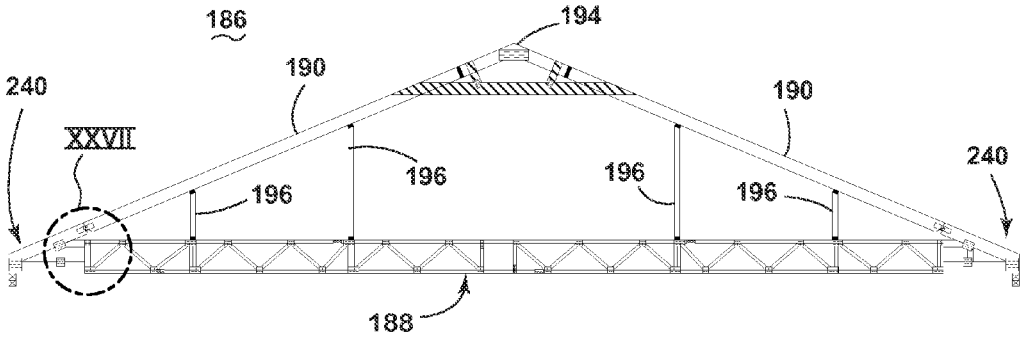
FIG. 26 is a front view of a pitched roof truss according to a tenth embodiment of the invention.

FIG. 26 is a front view of a pitched roof truss 186 according to a tenth embodiment of the invention. The roof truss 186 of the tenth embodiment can comprise a 5/12 pitch truss, and is generally similar to the roof truss 186 of the ninth embodiment shown in FIG. 24, save for the configuration of the heel 240, and like elements are identified with the same reference numerals.

Figure 27:
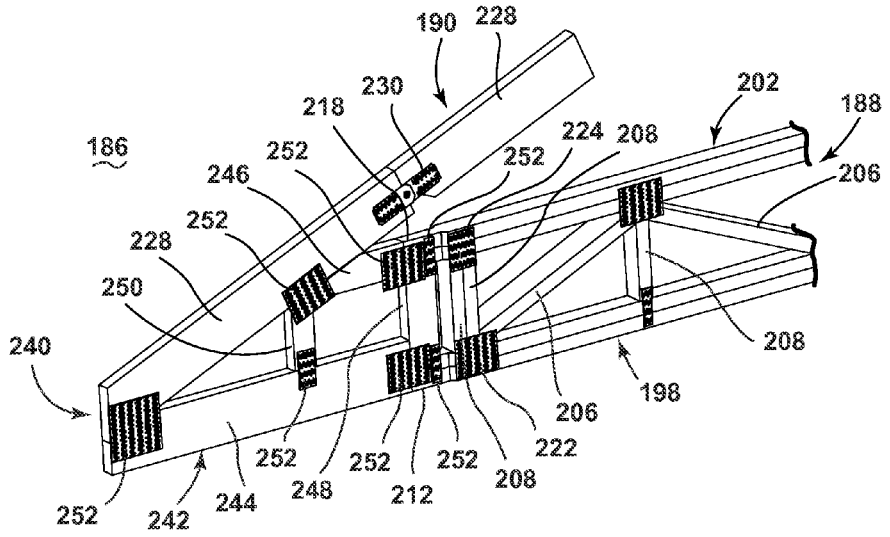
FIG. 27 is a detailed view of the heel of the roof truss from FIG. 26.

FIG. 27 is a detailed view of the heel 240 of the roof truss 186 from FIG. 26. The heel 240 of the tenth embodiment differs from the heel 192 of the ninth embodiment in eliminating the brace member 232 and adding a framework 242 which joins the minor portions 212, 218 of the joist 188 with the top chord 190 of the roof truss 186. The framework 242 includes a lower horizontal member 244 extending between the bottom chord 198 and the top chord 190, an upper horizontal member 246 parallel to the lower horizontal member 244 and extending between the top chords 190, 202, and two spaced vertical members 248, 250. The inner vertical member 248 abuts the ends of the horizontal members 244, 246 and extends between the chords 198, 202 of the joist 188. The outer vertical member 250 extends between the lower horizontal member 244 and the top chord 190 of the roof truss 186, and abuts the end of the upper horizontal member 246.

The framework 242 has one major dimension, shown herein as the width, which is approximately the same as that of the minor portions 212, 218 of the joist 188 and the top chord 190 of the roof truss 186. As such, flat metal plates 252 can be used for the fixed connections between the minor portions 212, 218 of joist 188, the members of the framework 242, and the top chord 190 of the roof truss 186.

In one example, the diagonal and vertical webs 206, 208 can be 3× or 4× wood members, and the top chords 190 and members of the framework 242 can be 2× wood members. To join these members of differing dimensions, the chords 198, 202 of the truss joist 188 are provided with necked portions 214, 220 which transition the stacked members 200, 204 from 3× or 4× members to 2× members at or near the heel 240. Here, the 3× or 4× members are used for only part of the span of the truss 186, with the chords 198, 202 necking down to join with the 2× framework 242.

Figure 28:
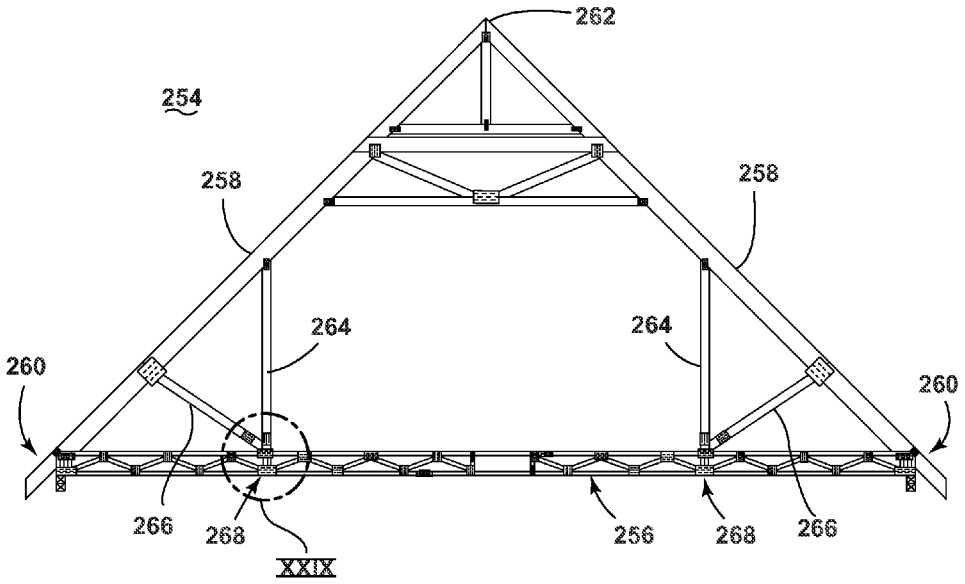
FIG. 28 is a front view of a pitched roof truss according to an eleventh embodiment of the invention.

FIG. 28 is a front view of a pitched roof truss 254 according to an eleventh embodiment of the invention. The roof truss 254 of the eleventh embodiment can comprise a 12/12 pitch truss, and generally includes a bottom chord in the form of a parallel chord truss joist 256, and two top chords 258 which are mounted to the outer ends of the joist 256 at a heel 260 and meet at a peak 262. Vertical and diagonal webs 264, 266 extend between the joist 256 and the top chords 258 for structural support.

While not illustrated in detail, the heel 260 of the roof truss 254 can have a configuration that is substantially identical to the heel 126 of the fourth embodiment shown in FIG. 17, such that the nominal dimensions of the members used for at least some of the lower members of the truss 254 can be larger than those of the upper members of the truss 254, while still using flat metal connector plates for the fixed connections. For example, the lower members of truss 254, like the bottom chord and diagonal webs of the joist 256 can be 3× or 4× wood members, while the top chords 258 can be 2× wood members.

Figure 29:
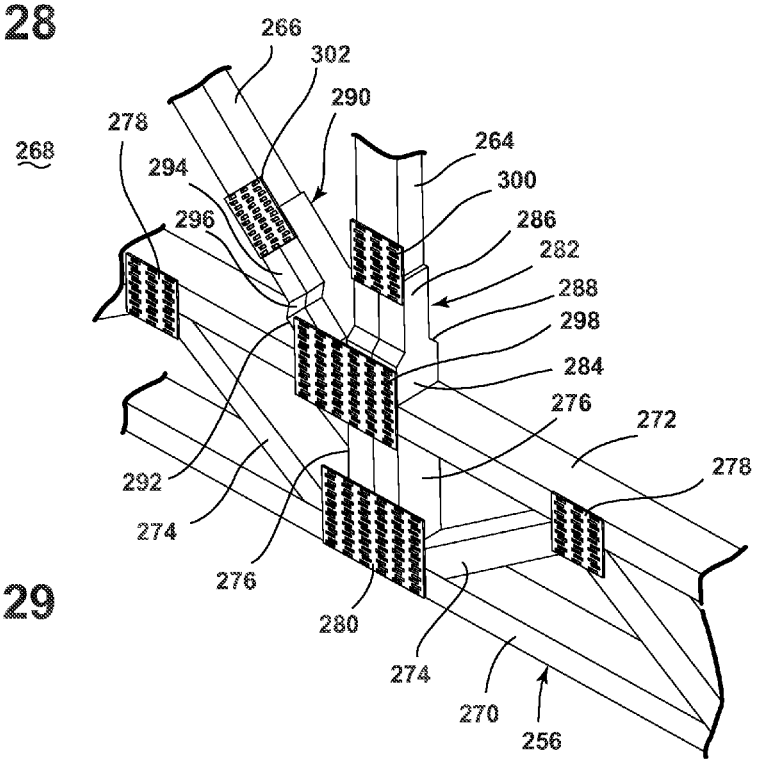
FIG. 29 is a detailed view of a joint of the roof truss from FIG. 28.

FIG. 29 is a detailed view of a joint 268 between the joist 256 and webs 264, 266 of the roof truss 254 from FIG. 28. The joist 256 includes a bottom chord 270 and a top chord 272 which is parallel to the bottom chord 270. Multiple diagonal webs 274 extend between the chords 270, 272 for structural support. Multiple vertical webs 276 also extend between the chords 270, 272 and are abutted by one of the diagonal webs 274. At the joint 268, for example, two vertical webs 276 are stacked together in an abutting relationship, and each is abutted by one of the diagonal webs 274.

The chords 270, 272 and webs 274, 276 have one major dimension, shown herein as the width, which are approximately equal to each other. As such, flat metal plates 278 can be used for the fixed connections between the diagonal webs 274 and the chords 270, 272, though only metal plates 278 connecting the diagonal webs 274 to the top chord 272 are visible in FIG. 29. Likewise, another flat metal plate 280 can be used for the fixed connection between the bottom chord 270, and the vertical webs 276.

The vertical web 264 of the roof truss 254 can be joined with the joist 256 using one or more fundamental components. As shown, two vertical components 282 are stacked together in an abutting relationship between the top chord 272 and the vertical web 264. Each vertical component 282 includes an elongated rectilinear body having a major portion 284 and a minor portion 286 joined by at least one necked portion 288. The components 282 are oriented with the major portions 284 aligned together and supported on the upper surface of the top chord 272, and the minor portions 286 aligned together and abutting an end of the vertical web 264.

The diagonal web 266 of the roof truss 254 can also be joined with the joist 256 using one or more fundamental components. As shown, two diagonal components 290 are stacked together in an abutting relationship between the top chord 272 and the diagonal web 266. Each diagonal component 290 includes an elongated rectilinear body having a major portion 292 and a minor portion 294 joined by at least one necked portion 296. The components 290 are oriented with the major portions 292 aligned together and supported on the upper surface of the top chord 272 while also abutting one of the vertical fundamental components 282, and the minor portions 294 aligned together and abutting an end of the diagonal web 266.

The major portions 284, 292 of the components 282, 290 have one major dimension, shown herein as the width, which is approximately the same as that of the top chord 272 and of each other. As such, a single flat metal plate 298 can be used for the fixed connection between the top chord 272 and the components 282, 290.

The necked portions 288, 296 change the widths of the components 282, 290, such that the minor portions 286, 294 are narrower. As such, the minor portions 286, 294 of the components 282, 290 have one major dimension, shown herein as the width, which is approximately the same as that of their respective web 264, 266, so that a flat metal plate 300, 302 can be used for the fixed connections between the minor portions 286, 294 and the webs 264, 266, respectively.

In one example, the chords 270, 272 and webs 274, 276 of the joist 256 can be 3× or 4× wood members, and the top chords 258 and webs 264, 266 of the truss 254 can be 2× wood members. To join these members of differing dimensions, the fundamental components 282, 290 connecting the webs 264, 266 to the joist 256 can be provided with necked portions 288, 296 which transition the fundamental components 282, 290 from 3× or 4× members to 2× members at or near the joint 268. The 3× or 4× members are used for substantially the full span of the truss 254.

Figure 30:
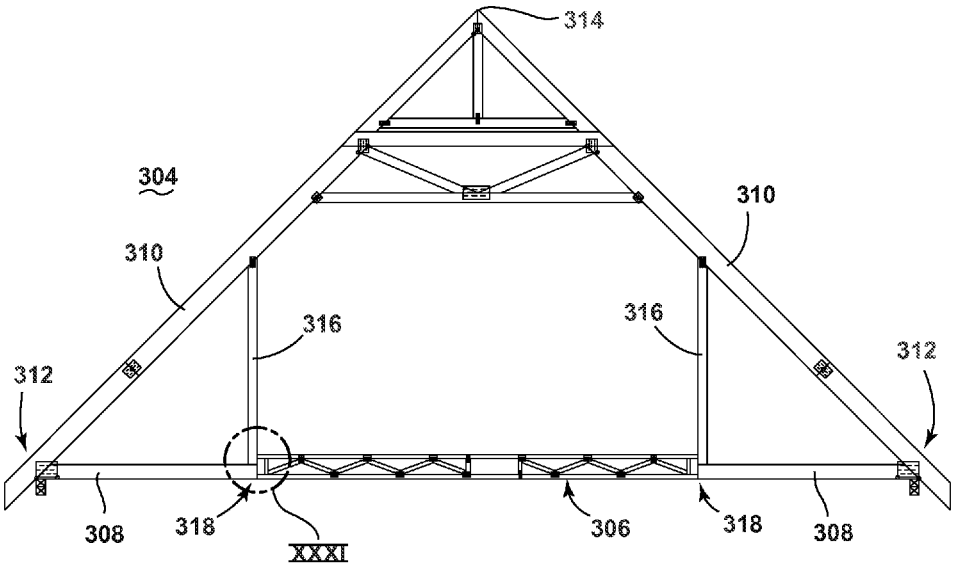
FIG. 30 is a front view of a pitched roof truss according to a twelfth embodiment of the invention.

FIG. 30 is a front view of a pitched roof truss 304 according to a twelfth embodiment of the invention. The roof truss 304 of the twelfth embodiment can comprise a 12/12 pitch truss, and generally includes a bottom chord in the form of a parallel chord truss joist 306 connected between two horizontal beams 308, and two top chords 310 which are mounted to the outer ends of the horizontal beams 308 at a heel 312 and meet at a peak 314. Vertical webs 316 extend between the bottom chord and the top chords 310 for structural support, and are joined with the joist 306 one of the horizontal beams 308 at a joint 318.

Figure 31:
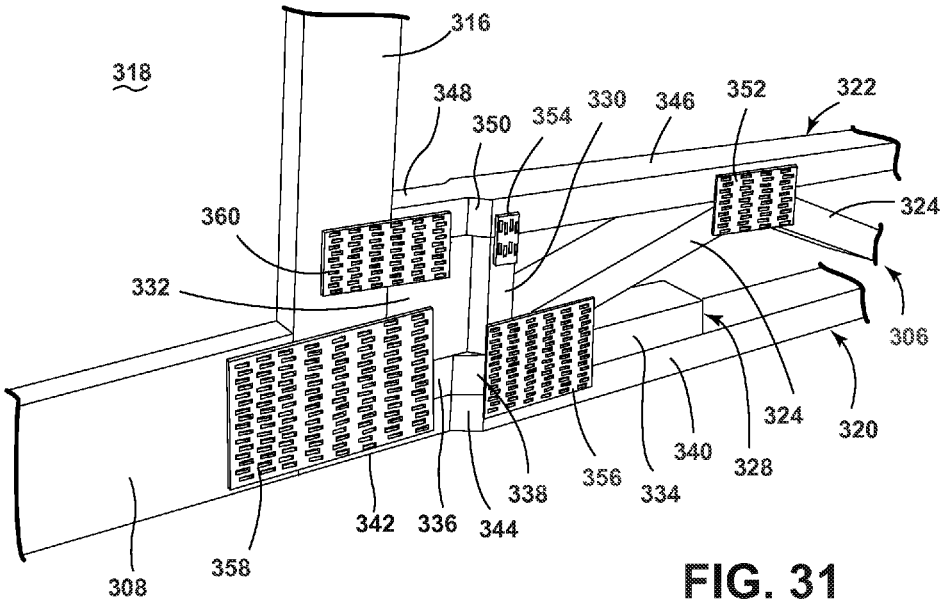
FIG. 31 is a detailed view of a joint of the roof truss from FIG. 30.

FIG. 31 is a detailed view of one of the joints 318 between the joist 306, beam 308, and web 316 of the roof truss 304 from FIG. 30. The joist 306 includes a bottom chord 320 and a top chord 322 which is parallel to the bottom chord 320. Multiple diagonal webs 324 extend between the chords 320, 322 for structural support.

A framework joins the joist 306 with the horizontal beam 308 and vertical web 316 of the roof truss 304. The framework includes a lower horizontal fundamental component 328 that is stacked with the bottom chord 320 and two vertical brace members 330, 332 extending between the lower horizontal fundamental component 328 and the top chord 322. The inner vertical brace member 330 abuts one of the diagonal webs 324, and the outer vertical brace member 332 is in abutting relationship with the web 316 and the inner vertical brace member 334.

The lower horizontal fundamental component 328 includes an elongated rectilinear body having a major portion 334 and a minor portion 336 joined by at least one necked portion 338. Likewise, the chords 320, 322 can be formed as fundamental components, described above. Accordingly, the bottom chord 320 includes an elongated rectilinear body having a major portion 340 and a minor portion 342 joined by at least one necked portion 344. Similarly, the top chord 322 includes an elongated rectilinear body having a major portion 346 and a minor portion 348 joined by at least one necked portion 350. The lower horizontal fundamental component 328 and chords 320, 322 are oriented with their minor portions 336, 342, 348 substantially aligned together and facing the joint 318.

The major portions 340, 346 of the chords 320, 322, the major portion 334 of the lower horizontal fundamental component 328, the diagonal webs 324 and the inner vertical brace member 330 have one major dimension, shown herein as the width, which is approximately equal to each other. As such, one flat metal plate 352 can be used for the fixed connection between the top chord 322 and the diagonal webs 324, another flat metal plate 354 can be used for the fixed connection between the top chord 322 and the vertical brace member 330, and yet another flat metal plate 356 can be used for the fixed connection between the bottom chord 320, the lower horizontal fundamental component 328, and the vertical brace member 330.

The necked portions 338, 344, 350 change the widths of the lower horizontal fundamental component 328 and the chords 320, 322, such that the minor portions 336, 342, 348 are narrower. With the abutted configurations of the bottom chord 320, lower horizontal fundamental component 328, outer vertical brace member 332, horizontal beam 308, and vertical web 316 shown in FIG. 31, a flat metal plate 358 can be used to join the joist 306 with the horizontal beam 308 forming the bottom chord and webs 316 of the roof truss 304, even though the horizontal beams 308 and the webs 316 have a width that is smaller than that of at least some of the members of the joist 306. Similarly, a flat metal plate 360 can be used to join the joist 306 with the webs 316 of the roof truss 304 at the top chord 322.

In one example, the webs 324 and inner vertical brace member 330 of the joist 306 can be 3× or 4× wood members, and the horizontal beams 308, top chords 310 of the truss 304, vertical webs 316, and outer vertical brace member 332 can be 2× wood members. To join these members of differing dimensions, the lower horizontal fundamental component 328 and the chords 320, 322 creating the joint 318 can be provided with necked portions 338, 344, 350 which transition the fundamental components from 3× or 4× members to 2× members at or near the joint 318. The 3× or 4× members are used for only part of the span of the truss 304, with the chords 320, 322 and the lower horizontal fundamental component 328 necking down to join with the 2× horizontal beams 308.

Figure 32:
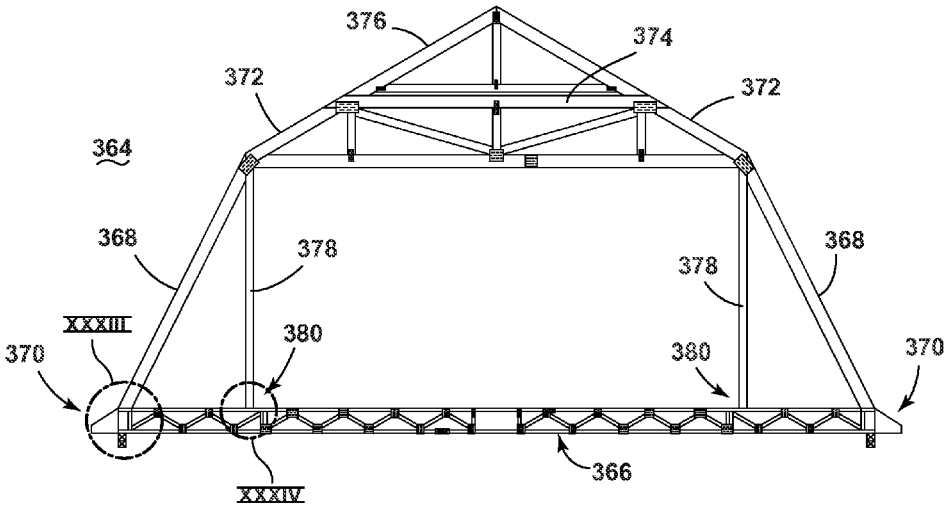
FIG. 32 is a front view of a pitched roof truss according to a thirteenth embodiment of the invention.

FIG. 32 is a front view of a pitched roof truss 364 according to a thirteenth embodiment of the invention. The roof truss 364 of the thirteenth embodiment can comprise a gambrel attic truss with a 24/12 lower pitch and a 7/12 upper pitch, and generally includes a bottom chord in the form of a parallel chord truss joist 366, two lower top chords 368 which are mounted to the outer ends of the joist 366 at a heel 370, two upper top chords 372 which are mounted to the lower top chords 368, and a center top chord 374 with joins the upper top chords 372. A piggyback truss 376 can be provided atop the center top chord 374 and defines the peak of the roof truss 364. Vertical webs 378 extend from a joint between the lower and upper top chords 368, 372 and are joined with the joist 366 at a joint 380.

Figure 33:
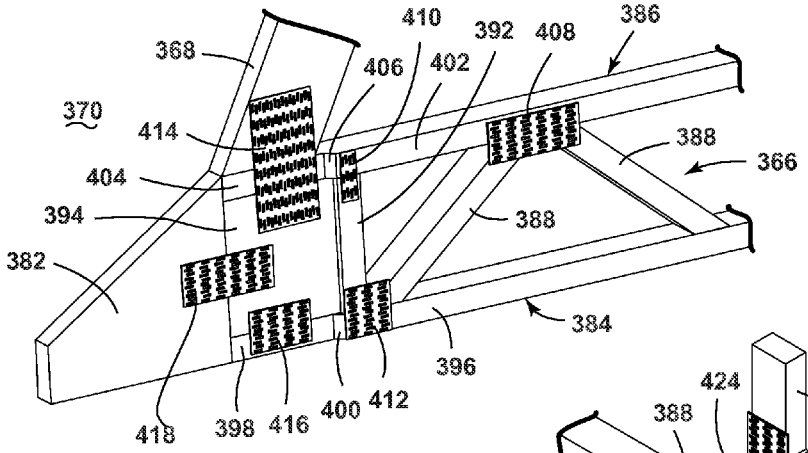
FIG. 33 is a detailed view of a heel of roof the truss from FIG. 32.

FIG. 33 is a detailed view of the heel 370 of the roof truss 364 from FIG. 32. The heel 370 includes various fixed connections between the joist 366, the lower top chords 368, and an overhang 382 of the roof truss 364. The joist 366 includes a bottom chord 384 and a top chord 386 which is parallel to the bottom chord 384. Multiple diagonal webs 388 extend between the chords 384, 386 for structural support.

A framework joins the joist 366 with the lower top chord 386 and overhang 382 of the roof truss 364. The framework includes two vertical brace members 392, 394 extending between the lower horizontal fundamental component 328 and the top chord 322. The inner vertical brace member 392 abuts one of the diagonal webs 388, and the outer vertical brace member 394 is in abutting relationship with the overhang 382.

The chords 384, 386 can be formed as fundamental components, described above. Accordingly, the bottom chord 384 includes an elongated rectilinear body having a major portion 396 and a minor portion 398 joined by at least one necked portion 400. Similarly, the top chord 386 includes an elongated rectilinear body having a major portion 402 and a minor portion 404 joined by at least one necked portion 406. The chords 384, 386 are oriented with their minor portions 398, 404 substantially aligned together and facing the heel 370.

The major portions 396, 402 of the chords 384, 386, the diagonal webs 388 and the inner vertical brace member 392 have one major dimension, shown herein as the width, which is approximately equal to each other. As such, one flat metal plate 408 can be used for the fixed connection between the top chord 386 and the diagonal webs 388, another flat metal plate 410 can be used for the fixed connection between the top chord 386 and the vertical brace member 392, and yet another flat metal plate 412 can be used for the fixed connection between the bottom chord 384, the diagonal web 388, and the vertical brace member 392.

The necked portions 400, 406 change the widths of the chords 384, 386, such that the minor portions 398, 404 are narrower. With the abutted configurations of the top chord 386, outer vertical brace member 394, and lower top chord 368 shown in FIG. 33, a flat metal plate 414 can be used to join the joist 366 with the upper members of the roof truss 364, even though the upper members of the roof truss 364 have a width that is smaller than that of at least some of the members of the joist 366. Similarly, a flat metal plate 416 can be used to join the joist 366 with the framework at the bottom chord 384 and outer vertical brace member 394, and another flat metal plate 418 can be used to join the joist 366 with the overhang 382 of the roof truss 364 at the outer vertical brace member 394.

Figure 34:
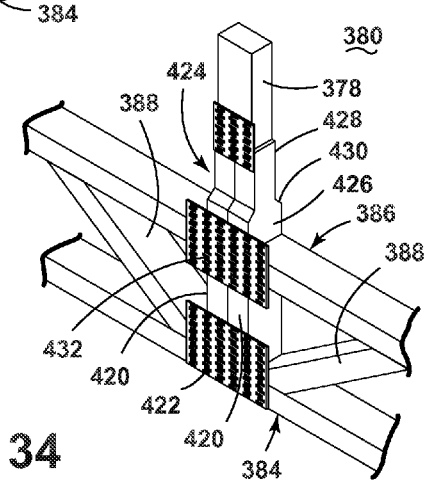
FIG. 34 is a detailed view of a joint of the roof truss from FIG. 32.

FIG. 34 is a detailed view of the joint 380 of the roof truss 364 from FIG. 32. In addition to the diagonal webs 388, the joist 366 includes multiple vertical webs 420 that extend between the chords 384, 386 for structural support, and are abutted by one of the diagonal webs 388. At the joint 380, for example, two vertical webs 420 are stacked together in an abutting relationship, and each is abutted by one of the diagonal webs 388.

The chords 384, 386 and webs 388, 420 have one major dimension, shown herein as the width, which are approximately equal to each other. As such, flat metal plates 422 can be used for the fixed connections between the diagonal webs 388 and the chords 384, 386, though only one plate 422 connecting the diagonal webs 388 to the bottom chord 384 is visible in FIG. 34. At the joint 380, the metal plate 422 further connects the vertical webs 420 to the bottom chord 384.

The vertical web 378 of the roof truss 364 can be joined with the joist 366 using one or more fundamental components. As shown, two vertical components 424 are stacked together in an abutting relationship between the top chord 386 and the vertical web 378. Each vertical component 424 includes an elongated rectilinear body having a major portion 426 and a minor portion 428 joined by at least one necked portion 430. The components 424 are oriented with the major portions 426 aligned together and supported on the upper surface of the top chord 386, and the minor portions 428 aligned together and abutting an end of the vertical web 378.

The major portion 426 of the components 424 have one major dimension, shown herein as the width, which is approximately the same as that of the top chord 386 and of each other. As such, a single flat metal plate 432 can be used for the fixed connection between the top chord 386, the vertical webs 420, and the components 424.

The necked portion 430 changes the width of the component 424, such that the minor portion 428 is narrower. As such, the minor portion 428 of the components 424 has one major dimension, shown herein as the width, which is approximately the same as that of the vertical web 378, so that a flat metal plate 434 can be used for the fixed connection between the vertical components 424 and the vertical web 378.

In one example, the webs 388, 420 and inner vertical brace member 392 of the joist 366 can be 3× or 4× wood members, and the top chords 368, 372, 374 of the truss 364, vertical webs 378, overhang 382, and outer vertical brace member 394 can be 2× wood members. To join these members of differing dimensions, the chords 384, 386 creating the heel 370 can be provided with necked portions 406, 400 which transition the fundamental components from 3× or 4× members to 2× members at or near the heel 370 and the fundamental components 424 connecting the vertical webs 378 to the joist 366 can be provided with necked portions 430 which transition the fundamental components 424 from 3× or 4× members to 2× members at or near the joint 380. The 3× or 4× members are used for substantially the full span of the truss 364.

Figure 35:
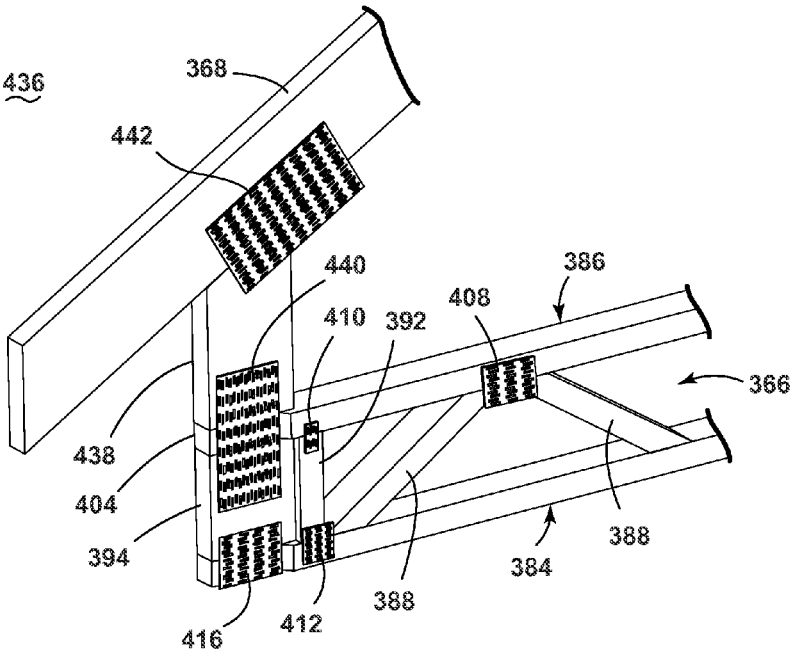
FIG. 35 is a front view of a heel for a roof truss according to a fourteenth embodiment of the invention.

FIG. 35 is a detailed view of a heel 436 of a pitched roof truss according to a fourteenth embodiment of the invention. The heel 436 of the fourteenth embodiment can be a modified version of the heel 370 shown for the roof truss 364 of FIG. 33, and like elements are identified with the same reference numerals. The heel 436 differs from the heel 370 by including a vertical member 438 fitted between the joist 366 and the top chord 368, thereby raising the top chord 368. The heel 436 also differs by eliminating the separate overhang 382 and creating an overhang using the top chord 368. The heel 436 can be used on a non-gambrel attic truss; for example, the heel 436 shown herein can be used for a 7/12 pitch raised heel truss, similar to that shown in FIG. 16.

The vertical member 438 has one major dimension, shown herein as the width, which is approximately equal to that of the minor portion 404 of the top chord 386 and the outer vertical brace member 394. As such, one flat metal plate 440 can be used for the fixed connection therebetween. The width of the vertical member 438 is also substantially equal to that of the top chord 368, such that another flat metal plate 442 can be used for the fixed connection therebetween.

Figure 36:
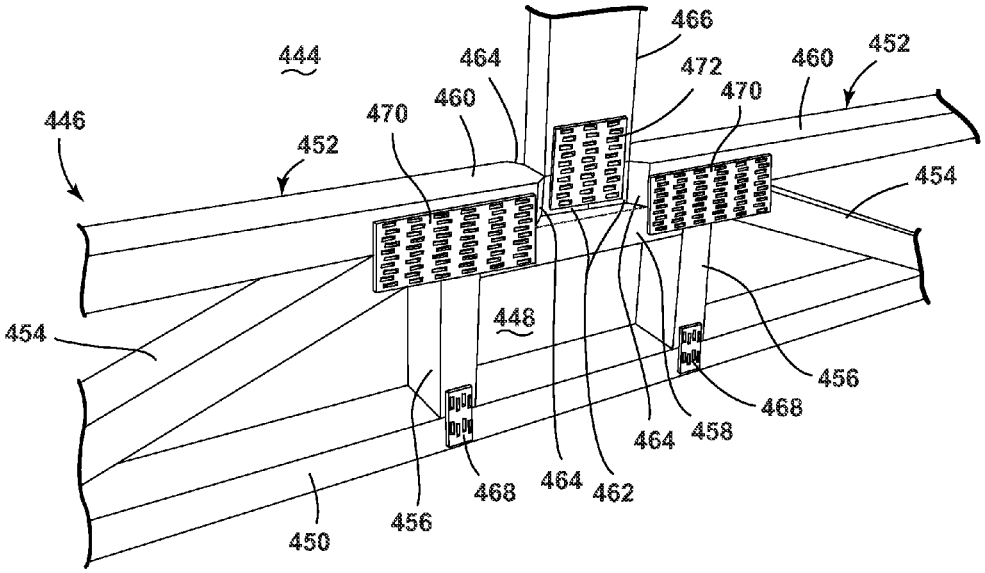
FIG. 36 is a perspective view of a joint according to a fifteenth embodiment of the invention.

FIG. 36 is a perspective view of a joint 444 according to a fifteenth embodiment of the invention. The joint 444 may form a portion of a roof truss, and can be used for any of a number of joints common to a roof truss; for example, as shown herein the joint 444 can be used in a parallel chord truss joist 446 over a chase 448 through which utilities such as ducts can be run.

The joist 446 includes a bottom chord 450 and a top chord defined by two horizontal chord members 452 which are parallel to the bottom chord 450. Multiple diagonal webs 454 extend between the chords 450, 452 for structural support. A pair of spaced vertical webs 456 also extend between the chords 450, 452 to at least partially define the chase 448, and are abutted by one of the diagonal webs 454. The chase 448 is further defined by a horizontal brace member 458 extending between the vertical webs 456 and beneath the top chord members 452.

The top chord members 452 can be formed as fundamental components, described above. Accordingly, each top chord member 452 includes an elongated rectilinear body having a major portion 460 and a minor portion 462 joined by at least one necked portion 464. The top chord members 452 are oriented with their minor portions 462 substantially abutted together over the horizontal brace member 458.

A vertical member 466 is jointed with the top chord members 452 at the abutted minor portions 462. In one example, the vertical member 466 may be a vertical web providing structural support for the upper members of a roof truss.

The bottom chord 450, major portions 460 of the top chord members 452, diagonal webs 454, vertical webs 456, and brace member 458 have one major dimension, shown herein as the width, which is approximately equal to that of each other. As such, flat metal plates 468 can be used for the fixed connection between the bottom chord 450 and the webs 454, 456 (although only the connections with the vertical webs 456 are visible in FIG. 26). Additional flat metal plates 470 can be used for the fixed connections between the top chord members 452, the webs 454, 456, and the brace member 458.

The necked portions 464 change the widths of the top chord members 452, such that the minor portions 462 are narrower. With the abutted configuration of the top chord members 452 and vertical member 466 shown in FIG. 36, a flat metal plate 472 can be used to join the joist 446 with the vertical member 466, even though the vertical member 466 has a width that is smaller than that of the members of the joist 446. This joint 444 may be useful when configuring the joist 446 over a chase 448 as well as to join with upper roof truss members having at least one smaller nominal dimension.

Figure 37:
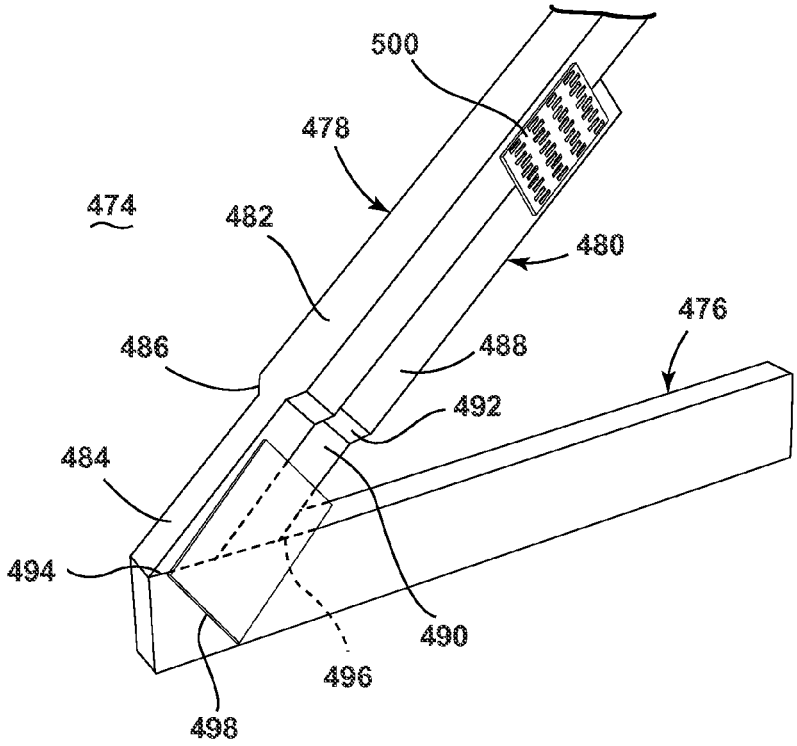
FIG. 37 is a perspective view of a joint according to a sixteenth embodiment of the invention.

FIG. 37 is a perspective view of a joint 474 according to a sixteenth embodiment of the invention. The joint 474 may form a portion of a roof truss, and can be used for any of a number of joints common to a roof truss; for example, as shown herein the joint 474 can be used to create a heel for a roof truss or to make other structural connections, such as those providing internal web support for a roof truss.

The joint 474 includes a lower horizontal member 476, an upper diagonal member 478, and a diagonal brace member 480 which is stacked with the upper diagonal member 478. The upper diagonal member 478 and brace member 480 can be formed as fundamental components, described above. Accordingly, the upper diagonal member 478 includes an elongated rectilinear body having a major portion 482 and a minor portion 484 joined by at least one necked portion 486. The brace member 480 includes an elongated rectilinear body that is shorter than the upper diagonal member 478 and includes a major portion 488 and a minor portion 490 joined by at least one necked portion 492. The members 478, 480 are oriented with their minor portions 484, 490 substantially abutted together with the lower horizontal member 476. At their respective minor portions 484, 490, the members 478, 480 have terminal ends 494, 496 which are shown as being angled in order to substantially abut the top surface of the lower horizontal member 476.

The minor portions 484, 490 of the members 478, 480 have one major dimension, shown herein as the width, which is approximately the same as that of the lower horizontal member 476. As such, a flat metal plate 498 can be used for the fixed connection between the minor portions 484, 490 and the lower horizontal member 476. The necked portions 486, 492 change the widths of members 478, 480, such that the major portions 482, 488 are wider. A flat metal plate 500 can be used to fasten the brace member 480 along the bottom of the upper diagonal member 478. This joint 474 may be useful when configuring a roof truss with narrower lower members and wider upper members. It is noted that the holes in the metal plate 498 are not shown so that the terminal ends 494, 496 of the members 478, 480 may be seen more clearly, however, it is understood that the metal plate 498 can be provided with holes similarly to those shown for the other metal plate 500.

Figure 38:
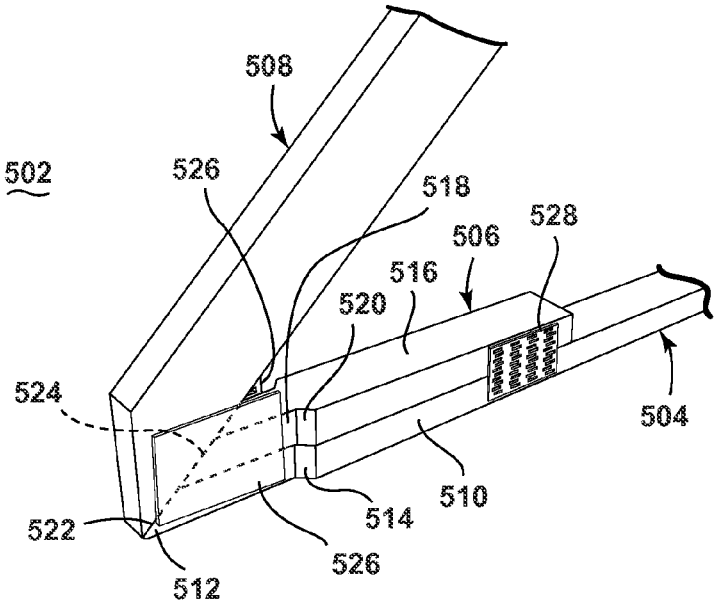
FIG. 38 is a perspective view of a joint according to a seventeenth embodiment of the invention.

FIG. 38 is a perspective view of a joint 502 according to a seventeenth embodiment of the invention. The joint 502 may form a portion of a roof truss, and can be used for any of a number of joints common to a roof truss; for example, as shown herein the joint 502 can be used to create a heel for a roof truss or to make other structural connections, such as those providing internal web support for a roof truss.

The joint 502 includes a lower horizontal member 504, a horizontal brace member 506 which is stacked with the lower horizontal member 504, and an upper diagonal member 508. The lower horizontal member 504 and brace member 506 can be formed as fundamental components, described above. Accordingly, the lower horizontal member 504 includes an elongated rectilinear body having a major portion 510 and a minor portion 512 joined by at least one necked portion 514. The brace member 506 includes an elongated rectilinear body that is shorter than the lower horizontal member 504 and includes a major portion 516 and a minor portion 518 joined by at least one necked portion 520. The members 504, 506 are oriented with their minor portions 512, 518 substantially abutted together with the upper diagonal member 508. At their respective minor portions 512, 518, the members 504, 506 have terminal ends 522, 524 which are shown as being angled in order to substantially abut the inside surface of the diagonal member 508.

The minor portions 512, 518 of the members 504, 506 have one major dimension, shown herein as the width, which is approximately the same as that of the diagonal member 508. As such, a flat metal plate 526 can be used for the fixed connection between the minor portions 512, 518 and the diagonal member 508. The necked portions 514, 520 change the widths of members 504, 506, such that the major portions 510, 516 are wider. A flat metal plate 528 can be used to fasten the brace member 506 along the top of the lower horizontal member 504. This joint 502 may be useful when configuring a roof truss with wider lower members and narrower upper members. It is noted that the holes in the metal plate 526 are not shown so that the terminal ends 522, 524 of the members 504, 506 may be seen more clearly, however, it is understood that the metal plate 526 can be provided with holes similarly to those shown for the other metal plate 528.

In any of the above-described embodiments, where stacked or abutted fundamental components are included, the necked portions are not required to be perfectly aligned, although they are illustrated as such. Slight or even major misalignment may be permitted as along as the major and/or minor portions of the fundamental components overlap enough to make the flat plate connection. One example of this is shown in FIG. 37, in which the necked portions 486, 492 of the upper diagonal member 478 and diagonal brace member 480 are in slight misalignment, but the minor portions 484, 490 and major portions 482, 488 overlap enough such that flat metal plates 498, 500 can still be used to make the connections. Another example of this is shown in FIG. 38, in which the necked portions 514, 520 of the lower horizontal member 504 and brace member 506 are in slight misalignment, but the minor portions 512, 518 and major portions 510, 516 overlap enough such that flat metal plates 526, 528 can still be used to make the connections.

Also, in any of the above-described embodiments, while the metal plates are only visible on one side of the various roof trusses, joists, heels, and joints shown in the drawings, for example on the front side, it is understood that the rear side of the various roof trusses, joists, heels, and joints also includes a metal plate connector. One example of this is shown in FIG. 38, in which a portion of another flat metal plate 526 is visible on the rear side of the joint 502 opposite the metal plate 526 on the front side. Further, in the above-described embodiments, while the metal plates are only visible on one side of the various roof trusses, joists, heels, and joints shown in the drawings, for example on the front side, it is understood that the rear side of the metal plate can have a collection of teeth, spikes, or nails projecting therefrom and into the members of the various roof trusses, joists, heels, and joints.

Existing truss building equipment will not readily allow the pressing of truss members at different orientations. For example, 2× members cannot be pressed alongside 3× or 4× members. Therefore portions of the truss may have to be pressed separately, and then brought together for joining at a final assembly press. In another contemplated embodiment, existing truss building equipment can be modified to accommodate the fundamental components described herein by adding one or more ½" or 1" thick plate(s), which may be metal or wood, for example, to account for the difference in elevation of the truss members. The plate(s) can be placed above and below the tampered down areas. Once the truss pressing equipment is modified with plate(s) or otherwise designed to address the difference in elevation, then the entire truss having truss members at different orientations can be fabricated in a single stage.

The above described embodiments provide for a variety of benefits, including the ability to easily and conveniently change the orientation of lumber used in various truss frameworks, including but not limited to, roof trusses, joists, heels, and joints, from vertical to horizontal, or vice versa, to achieve gains in strength, stiffness, and economy within the same truss framework. The above described embodiments of the invention allow for more versatile MPC wood truss designs, with benefits including: (1) increased strength of stiffness, with less deflection; (2) increased lateral stability; (3) larger openings for chases; and (4) wider nailing surface.

Historically, in the production of MPC wood trusses, the origination of each full truss member is constant along the length of the truss member. For example a roof truss or joist would consist of all 2×4 dimensional lumber or all 4×2 dimensional lumber but not a mixture of both. The fundamental component described herein provides the ability to design and build a fully integrated, MPC truss with portions of the truss with truss members in the different orientations.

Known prior trusses have all members oriented the same, i.e. have a vertical orientation in which the wider dimension of the lumber is oriented vertically or a horizontal orientation in which the wider dimension of the lumber is oriented horizontally. Truss designs that mix the two orientations generally result in extra in-factory or on-site field work. The extra work is needed to attach the various components together with common fasteners or hanger-style connectors. However, these types of connections generally do not have the capacity to resist moment forces typically found in these locations.

Some of the above described embodiments of the invention may also be stronger and stiffer compared to existing 2× truss configurations. Because of the wide face of the parallel chord truss joist members (such as chords and webs) making up the bottom chord on many of these roof trusses can be horizontally oriented, the lateral stability of the truss is greater. Also, there may be more open space between the parallel chord truss joist members, thus allowing for more room for chases for utilities, including heating, ventilation, air conditioning, electrical and plumbing systems. This additional space reduces the danger of drilling or cutting holes in the wrong place on the joist. The wide face of the parallel chord truss joist members further allows for more nailing surface for roof sheathing and interior finishes such as flooring.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A truss for incorporation into a building structure comprising:

a framework of truss members, a plurality of the truss members having a length and a rectilinear cross-section defined by major dimensions including a width and a depth;

a plurality of flat connector plates, each of the connector plates joining at least two of the plurality of the truss members by spanning the at least two of the plurality of the truss members;

a portion of the plurality of the truss members stacked together in an abutting relationship along their respective lengths to form stacked truss members; and of the stacked truss members each having a necked-down portion that reduces one major dimension to the width or depth of an adjacent one of the plurality of the truss members to define a necked-down dimension;

wherein the necked-down portions of the stacked truss members are aligned with each other and abutted with the adjacent one of the plurality of the truss members; and wherein a common connector plate connects the stacked truss members at least one other of the plurality of the truss members.

2. The truss of claim 1 wherein the plurality of flat connector plates comprise nail plates configured to be pressed into adjacent ones of the plurality of the truss members.

3. The truss of claim 1 wherein the plurality of the truss members comprise one of sawn lumber or engineered wood.

4. The truss of claim 1 wherein the plurality of the truss members comprise dimensional lumber.

5. The truss of claim 4 wherein one major dimension of the plurality of the truss members is selected from the group consisting of: nominal 3 inches, nominal 4 inches, and nominal 6 inches, and the other major dimension of the plurality of the truss members is nominal 2 inches.

6. The truss of claim 1 wherein the necked-down dimension is equal to the smaller of the width or depth of each respective stacked truss member, forming a square cross-section for the necked-down portions.

7. The truss of claim 1 wherein the necked-down portion of at least one of the stacked truss members comprises a tapered shoulder between the major dimension and the necked-down dimension.

8. The truss of claim 1 wherein the necked-down portion of at least one of the stacked truss members comprises a rounded shoulder between the major dimension and the necked-down dimension.

9. The truss of claim 1 wherein the necked-down portion of at least one of the stacked truss members comprises a generally-perpendicular shoulder between the major dimension and the necked-down dimension.

10. The truss of claim 1 wherein the necked-down portion of at least one of the stacked truss members is formed by a necked portion and a rectilinear portion adjacent to the necked portion.

11. The truss of claim 1 wherein the necked-down dimension in at least one of the stacked truss members is formed by joining a first truss portion having the major dimensions, and a second truss portion having the necked-down dimension and one of the major dimensions.

12. The truss of claim 1 wherein the framework of truss members forms a roof truss.

13. The truss of claim 12 wherein the roof truss comprises one of the group consisting of: a 7/12 pitch truss, a 12/12 pitch truss, a 10/12 pitch truss, a 5/12 pitch truss, and a gambrel attic truss.

14. The truss of claim 1 wherein the framework of truss members form a floor joist.

15. The truss of claim 1 wherein the framework of truss members form one of a joist, heel, or joint for a roof truss.

16. The truss of claim 1 wherein at least one of the plurality of flat connector plate comprises a hinged truss plate connector for pivotally connecting an adjacent pair of the plurality of truss members.

17. The truss of claim 1 wherein the truss members are horizontally stacked together.

18. The truss of claim 1 wherein the truss members are vertically stacked together.

19. A truss for incorporation into a building structure comprising:

a framework of truss members, a plurality of the truss members comprising:

a horizontally-extending bottom chord;

a horizontally-extending top chord; and a first web extending between the at least one bottom chord and the at least one top chord; and at least one second web extending between the bottom chord and top chord;

a plurality of flat connector plates, each of the connector plates joining at least two of the plurality of the truss members by spanning the at least two of the plurality of the truss members;

wherein horizontally-extending top chord comprises an elongated rectilinear body having a length and a rectilinear cross-section defined by major dimensions including a width and a depth, with a necked-down portion that reduces the depth from a first dimension to a second dimension that is less than the first dimension;

wherein the at least one first web comprises a depth equal to the first dimension and is connected with horizontally-extending top chord by one of the plurality of connector plates; and wherein the second web comprises a depth equal to the second dimension and is connected with the at least one horizontally-extending top chord at the necked-down portion by another one of the plurality of connector plates.

20. The truss of claim 19 wherein the at least one second web comprises a necked-down portion that is connected with the necked-down portion of the at least one horizontally-extending top chord by the another one of the plurality of connector plates.

* * * * *